US005911253A

United States Patent [19]

Webb

[11] Patent Number: 5,911,253

[45] Date of Patent: Jun. 15, 1999

[54] CONTAINER AND LIQUID DISPENSING APPARATUS AND METHOD OF APPLICATION THEREOF

[76] Inventor: James Elmer Webb, 13809 Hershe St., Houston, Tex. 77015

[21] Appl. No.: 09/036,876

[22] Filed: Mar. 9, 1998

[51] Int. Cl.[6] ..... B65B 3/06

[52] U.S. Cl. ..... 141/243; 141/1; 141/237; 141/244; 141/246; 141/242; 221/221

[58] Field of Search ..... 141/1, 237, 240, 141/242–244, 246; 221/221, 223

[56] References Cited

U.S. PATENT DOCUMENTS

| | | | |
|---|---|---|---|
| 474,965 | 5/1892 | McCormick | 141/244 |
| 516,065 | 3/1894 | Thomas | 141/246 |
| 1,202,439 | 10/1916 | Scott | 141/242 |
| 1,488,603 | 4/1924 | Kouwenhoven | 141/244 |
| 1,528,978 | 3/1925 | McClellan | 141/244 |
| 1,709,771 | 4/1929 | Brady | 141/242 |
| 1,882,668 | 10/1932 | McCabe | 141/242 |
| 2,618,394 | 11/1952 | Miller | 221/221 |
| 2,680,548 | 6/1954 | Karos | 141/246 |
| 2,872,953 | 2/1959 | Duncan | 141/237 |
| 2,975,809 | 3/1961 | Ninneman et al. | 141/244 |
| 3,196,909 | 7/1965 | Monk | 141/237 |
| 3,380,629 | 4/1968 | Kontra et al. | 222/26 |
| 3,420,407 | 1/1969 | Christine et al. | 221/221 |
| 3,435,986 | 4/1969 | Brosseit | 221/278 |
| 3,768,701 | 10/1973 | Leas et al. | 222/129 |
| 3,893,494 | 7/1975 | Whitney | 141/244 |
| 4,512,377 | 4/1985 | Greer | 141/11 |
| 4,618,073 | 10/1986 | Bartfield et al. | 221/11 |
| 5,024,048 | 6/1991 | Moore | 53/534 |
| 5,092,378 | 3/1992 | Dunham | 141/237 |

*Primary Examiner*—J. Casimer Jacyna
*Attorney, Agent, or Firm*—Maryam Bani-Jamali

[57] ABSTRACT

The invention provides a container dispensing apparatus and a liquid dispensing apparatus. The container dispenser includes a housing, axial bores for receiving a column of containers and a central, axial bore, a vertical bar attached to and uprising from the housing, upright legs that are attached to the peripheral wall of the housing, a cover being positioned above the housing and having a number of downwardly extending rods and a downwardly extending, central pipe, a guide for the vertical bar attached to the cover, a pair of friction pads separating the guide for the vertical bar from the vertical bar while acting as a reenforceable break to allow lifting and lowering of the cover along the vertical bar, a handle engaged with the vertical bar, a fulcrum that is attached to the cover and that is engaged with and supports the handle. The liquid dispenser has a housing with a side wall and a bottom wall. The bottom wall is provided with a number of liquid dispensing openings that are selectively positioned. A spider-like dispenser may be used as a replacement for the openings with the bottom wall having only one opening to which the spider is connected. A plate with liquid dispensing openings is positioned upon the bottom wall of the housing. Some openings of the plate, are positioned upon the number of liquid dispensing openings of the bottom wall when the plate is positioned along some upright bars upon the bottom wall. The liquid dispensing openings are retained exactly and directly above surfaces of the bottom wall. A lever serves to raise the plate.

26 Claims, 12 Drawing Sheets

CONTAINER AND LIQUID DISPENSING APPARATUS AND METHOD OF APPLICATION THEREOF

BACKGROUND OF THE INVENTION

1. Field of the Invention

This invention relates to a container and liquid dispensing apparatus and method of application thereof.

2. Description of the Prior Art

In churches, communion is served monthly or even weekly. Each communion receptacle is usually filled with 32 or more small individual cups. For centuries, liquid has been poured manually from a container into each cup one by one. Therefore, a considerable amount of time is consumed to arrange orderly, filled-up cups and the preparation process is extremely tiresome. A speeded process for arranging a desired number of containers and filling up the arranged containers with beverage would not only be helpful in churches, but would also be beneficial in large ceremonies such as other religious services, social gatherings, weddings, meetings, conferences and sports events where multiple containers are to be filled up simultaneously.

It is apparent that manual handling of elements represents a severe limitation in the efficiency of such processes. In the past few decades, numerous methods have been tried unsuccessfully to devise a way to fill receptacles of cups quickly and to pour liquid into the cups quickly. A wide variety of container dispensing apparatus and liquid dispensing apparatus have been designed in the past.

Numerous patents that have been issued in the past few decades and that are focused on various versions of container dispensing apparatus are:

Moore, U.S. Pat. No. 5,024,048, issued on Jun. 18, 1991, patents an apparatus for dispensing individual containers from a nested stack of containers. The apparatus comprises a first extendable arm for holding the stack of containers in an elevated position within a hollow column adapted to hold the stack of containers vertical, a second extendable arm for wedging the stack of containers, with the exception of the bottom container in the stack against the side of the column and a third extendable arm for contacting the bottom container in the stack to cause the bottom container to separate from the stack and fall.

Bartfield et al., U.S. Pat. No. 4,618,073, registered on Oct. 21, 1986, discuss a cup dispensing apparatus for housing a plurality of stacks of nested cups positioned side-by-side and including a dispensing device to sequentially dispense cups from one of the stacks in a dispensing column. The cups are sequentially advanced by using a pair of helical feed coils. A support in the form of a pivotable platform is provided below the dispensing column.

Brosseit, U.S. Pat. No. 3,435,986, issued on Apr. 1, 1969, patent a dispensing mechanism having an article distributing cylinder that is provided with a circumferentially arranged group of internal bores. The article distributing cylinder is indexed about its axis for receiving a succession of pneumatically conveyed articles. The articles are discharged in sequence from longitudinally spaced portions of the cylinder by means of radial passages extending from the bores to the cylinder periphery.

Christine et al., U.S. Pat. No. 3,420,407, issued on Jan. 7, 1969, patent a cup depositor assembly for depositing cups one at a time from a stack of cups. The cups are adapted to be placed in openings in a moving conveyor of a packaging machine.

Some of the above patents, along with numerous other patents that have been reviewed, are being used for dispensing containers. However, many patents that have been reviewed protect relatively complicated structures.

One group of the previously designed liquid dispensing apparatus, that more closely resemble the present invention, has been categorized as beverage dispensing apparatus. A common problem with beverage dispensing apparatus is a need for assemblage and disassemblage each time that the beverage dispensing apparatus is used. Usually in the beverage dispensing apparatus that more closely resemble the present invention, if instructions are not accurately followed, the unit would malfunction. Such beverage dispensing apparatus usually have small drain holes that clog easily with sediment.

A group of patents that have been issued and many other similar inventions that have been developed in the beverage industry, some of which still exist in the market, are relatively complicated. These patents and innovations in the market have been relatively complicated, including faucets, valves, metering and timing devices, gas pressure sources and beverage coolers, to name a few. Several such patents that have been issued in the past few decades and are focused on numerous versions of beverage dispensing apparatus follow:

Greer, U.S. Pat. No. 4,512,377, issued on Apr. 23, 1985, patents a beverage dispensing apparatus for filling numerous containers that are located proximate to a walk-in beverage cooler.

Leas et al., U.S. Pat. No. 3,768,701, registered on Oct. 30, 1973, discuss a liquid dispensing system that includes a plurality of receptacles connected in series one to another between a gas pressure source and a dispensing faucet.

Kontra et al., U.S. Pat. No. 3,380,629, issued on Apr. 30, 1968, patent an automatic beverage dispensing apparatus comprising a plurality of faucets. Each faucet includes a valve. An electronic metering and timing operator is connected to a solenoid which is attached to and operatively secured to the valve.

Another interesting patent that presents a liquid dispensing apparatus is U.S. Pat. No. 5,092,378, by Dunham, issued on Mar. 3, 1992. A communion cup filler is described that comprises a rectangular, angled central panel with a number of conduits each leading to a drain hole. The top of the central panel supports retaining walls on all 4 sides.

However, the present invention strives towards presenting a simple, inexpensive and easily manufacturable and transportable container and liquid dispensing apparatus that can be used ensemble as one unit even though a physical connection between the container dispensing apparatus and the liquid dispensing apparatus is not necessarily required as shown in FIG. 1.

SUMMARY OF THE INVENTION

A primary object of the invention is to devise a container and liquid dispensing apparatus that can be used to simultaneously and quickly dispense multiple containers and to fill the multiple containers simultaneously and quickly with liquid.

Another object of this invention is to devise a container and liquid dispensing apparatus that is inexpensive in design and simple and inexpensive to manufacture.

An additional object of this invention is to devise a container and liquid dispensing apparatus that has a simple and economical structure and low cost to maintain.

Another object of this invention is to devise a container and liquid dispensing apparatus that is clean to use, is easy to clean and does not clog due to poor cleaning.

Still another object of this invention is to devise a container and liquid dispensing apparatus that can be easily transported and moved, can be readily and easily set up and used and that does not require a significant amount of space.

Another object of this invention is to devise a container and liquid dispensing apparatus that, although it includes moving parts, it does not easily wear out, is durable and break resistant.

Yet another object of this invention is to devise a container and liquid dispensing apparatus that can be used by relatively unskilled labor with little instruction.

An additional object of this invention is to devise a container and liquid dispensing apparatus that fills each individual container accurately to the same amount and as desired.

A final object of this invention is to provide a container and liquid dispensing apparatus that enables control of the size of the dispensing of containers and the pour of the liquid.

Additional objects and advantages of the invention will be set forth in part in a detailed description which follows, and in part will be obvious from the description, or may be learned by practice of the invention.

The present invention provides a container and liquid dispensing apparatus that comprises a container dispensing apparatus, for simultaneously dispensing multiple containers, and a liquid dispensing apparatus, for simultaneously filling the containers with liquid. The container dispensing apparatus comprises a housing in the form of a block having a peripheral wall, internal, axial bores for receiving a column of containers and a central, axial bore, a vertical bar attached to and uprising from the housing, at least three upright legs that are attached to or are extensions of the peripheral wall of the housing, a cover being positioned above the housing and having a number of downwardly extending rods and a downwardly extending, central pipe, a guide for the vertical bar attached to the cover, a pair of friction pads separating the guide for the vertical bar from the vertical bar while acting as a reenforceable brake whereby a fixed screw set maintains a corresponding friction pad fixed and a second screw set allows the corresponding friction pad to be adjustable to allow lifting and lowering of the cover along the vertical bar, a handle engaged with the vertical bar, a fulcrum that is attached to the cover and that is engaged with and supports the handle.

The liquid dispensing apparatus has a housing that comprises a side wall and a bottom wall and that is mounted on at least three upright stands. The bottom wall of the housing is provided with a number of liquid dispensing openings that are selectively positioned for dispensing liquid. A plate with liquid dispensing openings is positioned upon the bottom wall of the housing. Some of the liquid dispensing openings of the plate are positioned upon the number of liquid dispensing openings of the bottom wall when the plate is positioned upon the bottom wall. However, such liquid dispensing openings of the plate are plugged at their end by rubber-like inserts. The liquid dispensing openings of the plate that are open, are retained exactly and directly above surfaces of the bottom wall and are not positioned above the number of liquid dispensing openings of the bottom wall, by positioning the plate through some upright bars. A primary vertical support is attached to the plate and a secondary vertical support is attached to the bottom wall. A lever runs between and connects the primary vertical support to the secondary vertical support and serves to raise the plate and enable pouring of liquid at any desired time and to any desired quantity. A spider-like dispenser may be used as a replacement for the number of liquid dispensing openings of the bottom wall of the housing for the liquid dispensing apparatus, with the bottom wall having only one liquid dispensing opening through which the liquid flows out and to which the spider-like dispenser is connected.

It is to be understood that the descriptions of this invention are exemplary and explanatory, but are not restrictive, of the invention. Other objects and advantages of this invention will become apparent from the following specification and from any accompanying charts, tables, examples and drawings.

BRIEF DESCRIPTION OF CHARTS, TABLES, EXAMPLES AND DRAWINGS

Any accompanying charts, tables, examples and drawings which are incorporated in and constitute a part of this specification, illustrate examples of preferred embodiments of the invention and, along with the description, serve to explain the principles of the invention.

Figure 1:
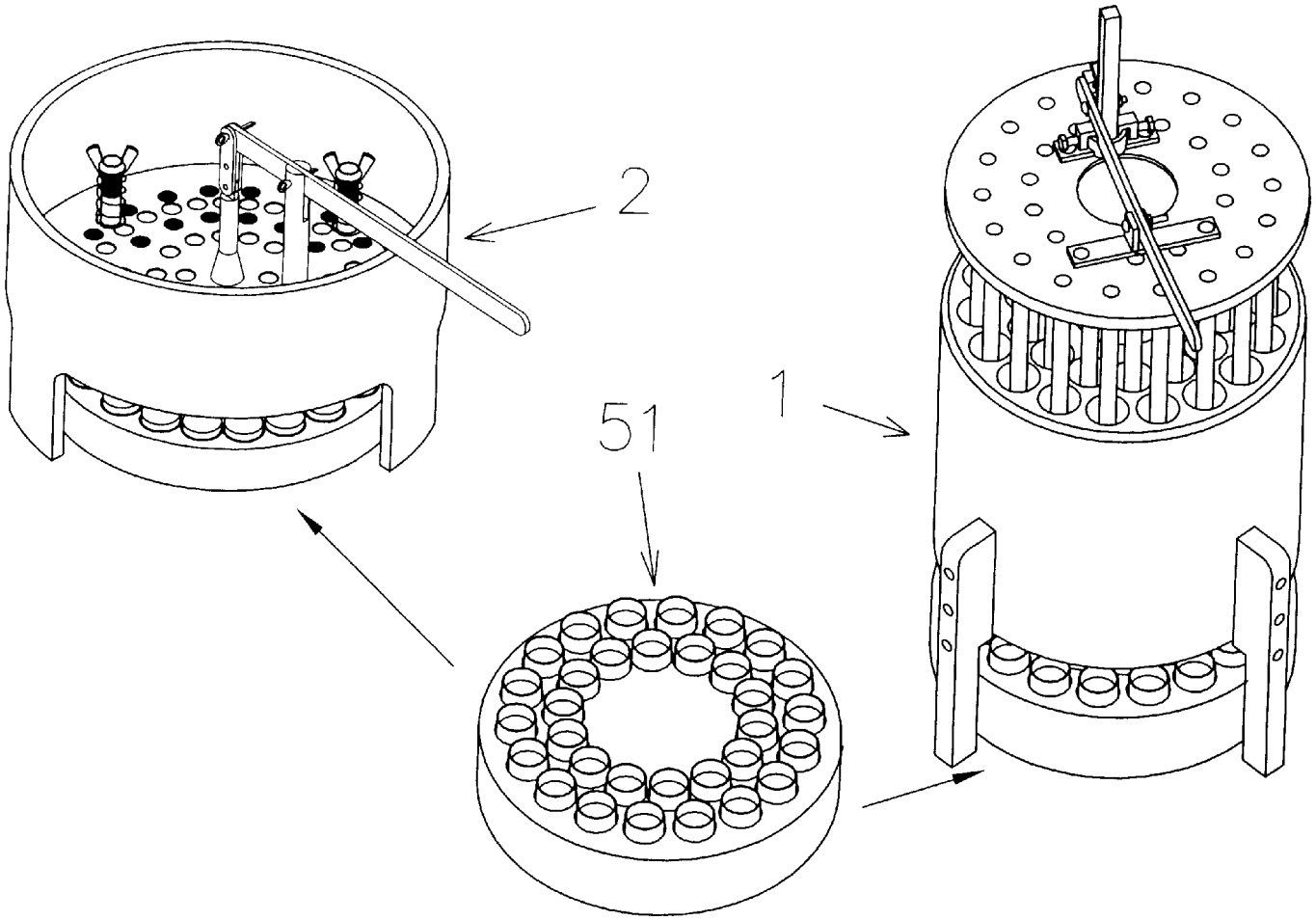
FIG. 1 shows an isometric view of a container and liquid dispensing apparatus, with a container receptacle filled with containers and shown with the container and liquid dispensing apparatus, and the receptacle of containers being moved from the container dispensing apparatus to the liquid dispensing apparatus.
Figure 6:
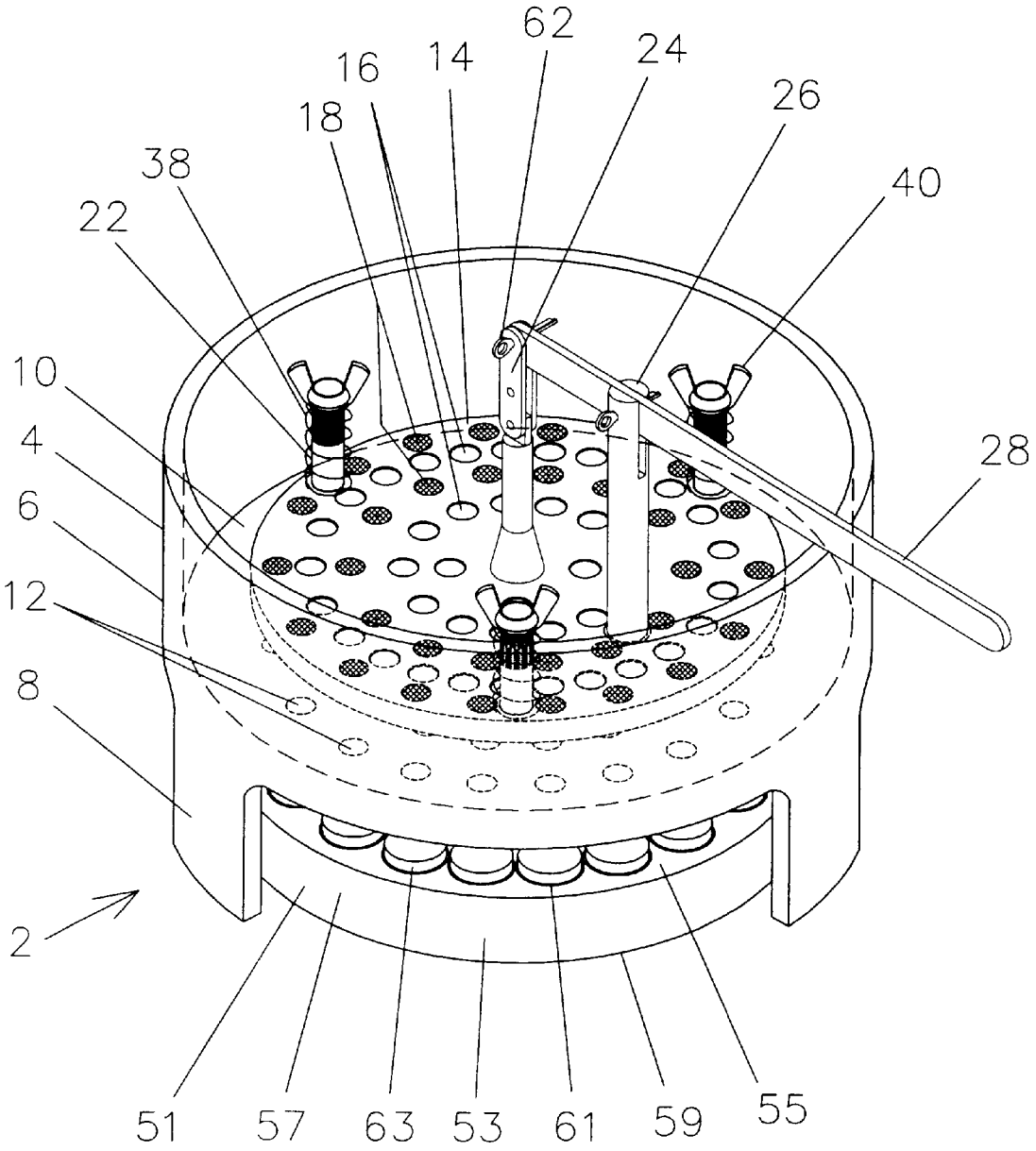

FIG. 6 shows an angular, upper isometric view of the liquid dispensing apparatus of the container and liquid dispensing apparatus, along with the receptacle of containers, FIG. 1, having a plate and a bottom wall in its liquid dispensing apparatus, with the plate being raised to allow an outpour of liquid into containers (positioned under the bottom wall) through a number of liquid dispensing openings of the bottom wall.

REFERENCE NUMBERS IN DRAWINGS

| | |
|---|---|
| 1 container dispensing apparatus | 2 liquid dispensing apparatus |
| 3 housing | 4 housing |
| 5 block | 6 side wall |
| 7 peripheral wall | 8 upright stands |
| 9 internal, axial bores | 10 bottom wall |
| 11 central, axial bore | 12 number of liquid dispensing openings (bottom wall) |
| 13 vertical bar | 14 plate |
| 15 upright legs | 16 liquid dispensing openings (of plate) |
| 17 cover | 18 rubber-like inserts |
| 19 number of downwardly extending rods | 20 spider-like dispenser |
| 21 downwardly extending, central pipe | 22 upright bars |
| 23 guide for the vertical bar | 24 primary vertical support |
| 25 fixed friction pad | 26 secondary vertical support |
| 27 fixed screw set | 28 lever |
| 29 adjustable friction pad | 30 upper section (upright bar) |
| 31 adjustable screw set | 32 lower section (upright bar) |
| 33 handle | 34 lower end (upright bar) |
| 35 fulcrum | 36 upper end (upright bar) |
| 37 pair of horizontal sides (guide) | 38 spring (upright bar) |
| 39 middle tubular body (guide) | 40 attachment (upright bar) |
| 41 holding means (guide) | 42 upper section (1ry vertical support) |
| 43 notches (vertical bar) | 44 lower section (1ry vertical support) |
| 45 spring4oaded pawl (handle) | 46 upper section (2ry vertical support) |
| 47 horizontal base (fulcrum) | 48 lower section (2ry vertical support) |
| 49 parallel vertical walls (fulcrum) | 50 vertical cut (1ry vertical support) |
| 51 receptacle | 52 vertical cut (2ry vertical support) |
| 53 receptacle housing | 54 support bar (1ry vertical support) |
| 55 top surtace (receptacle) | 56 connectable, holding elements (24) |
| 57 cylindrical side wall (receptacle) | 58 top end (support bar 54) |
| 59 bottom wall (receptacle) | 60 flat sheet with a hole (top end 58) |
| 61 liquid dispensing openings (top surface) | 62 removable blocking element |
| 63 containers | 64 front end (lever 28) |
| | 66 back end (lever 28) |
| | 68 number of openings (lever 28) |
| | 70 tubular connecting body (20) |
| | 72 valve (tubular connecting body 70) |
| | 74 switch (tubular connecting body 70) |
| | 76 base (tubular connecting body 70) |
| | 78 spider-leg tubes (base 76) |

DETAILED DESCRIPTION OF THE PREFERRED EMBODIMENT

Preferred embodiments of the present invention are illustrated in any charts, tables, examples and drawings that are included.

The present invention provides a container and liquid dispensing apparatus 1,2 (as shown in FIG. 1) for simultaneously and instantaneously dispensing multiple containers 63 and for filling the containers 63 simultaneously and instantaneously with a desired liquid. In its most general aspects, this container and liquid dispensing apparatus 1,2 rapidly dispenses the containers 63 into a series of spaced locations of an adjacent receptacle 51 positioned under the container and liquid dispensing apparatus 1,2. The container and liquid dispensing apparatus 1,2 comprises a container dispensing apparatus 1, for simultaneously and instantaneously dispensing multiple individual containers 63, and a liquid dispensing apparatus 2, for simultaneously and instantaneously filling the containers 63 with liquid. (Please refer to FIG. 1.) In describing the present invention, the term "liquid" includes, but is not limited to, all beverages and, in a preferred embodiment, the container and liquid dispensing apparatus 1,2 is designed for dispensing beverage in containers 63 in mass quantities. Such applications are particularly helpful in large ceremonies, which as stated before include religious services, social gatherings, weddings, meetings, conferences and sports events where multiple containers 63 are to be filled up simultaneously in a relatively high volume to be served to a relatively large number of attendants. The term "container" in the present invention basically refers to any container 63 for beverages such as cups, although no limitation exists on the type of containers 63.

Figure 2A:
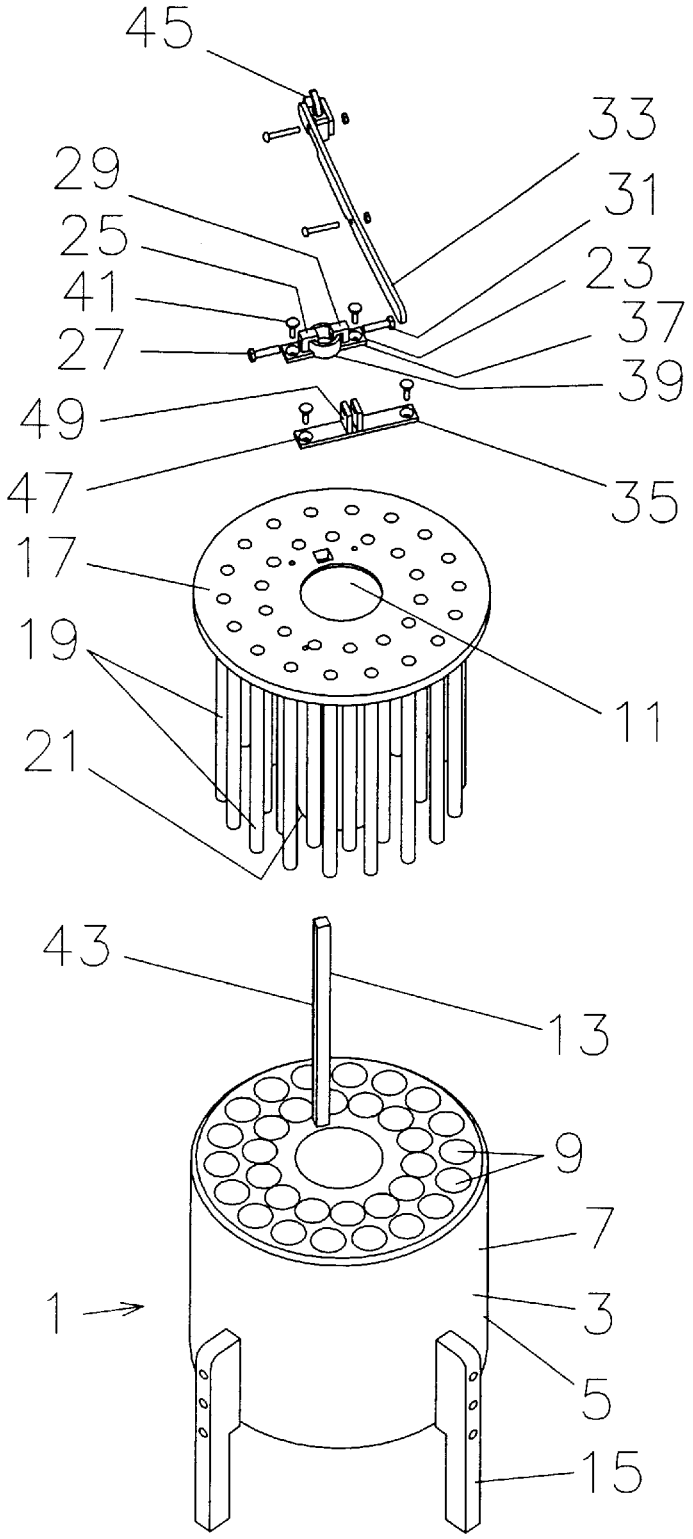
FIG. 2A shows an exploded isometric view of the container dispensing apparatus of the container and liquid dispensing apparatus of FIG. 1.

The container dispensing apparatus 1 (as shown in FIG. 2A) comprises a housing 3 in the form of a block 5 having a peripheral wall 7, internal, axial bores 9 for receiving a column of containers (not shown) and a central, axial bore 11, a vertical bar 13 attached to and uprising from the housing 3, at least three upright legs 15 that are attached to or are extensions of the peripheral wall 7 of the housing 3, a cover 17 being positioned above the housing 3 and having a number of downwardly extending rods 19 and a downwardly extending, central pipe 21, a guide 23 for the vertical bar 13 attached to the cover 17, a pair of friction pads 25,29 separating the guide 23 for the vertical bar 13 from the vertical bar 13 while acting as a reenforceable brake whereby one screw set 27 ("fixed screw set 27") maintains one corresponding friction pad 25 ("fixed friction pad 25") fixed and a second screw set 31 ("adjustable screw set 31") allows the corresponding friction pad 29 ("adjustable friction pad 29") to be adjustable to allow lifting and lowering of the cover 17 along the vertical bar 13, a handle 33 engaged with the vertical bar 13, a fulcrum 35 that is attached to the cover 17 and that is engaged with and supports the handle 33. The friction pads 25,29 are preferably U-shaped. (Please refer to FIG. 2A.)

Figure 4A:
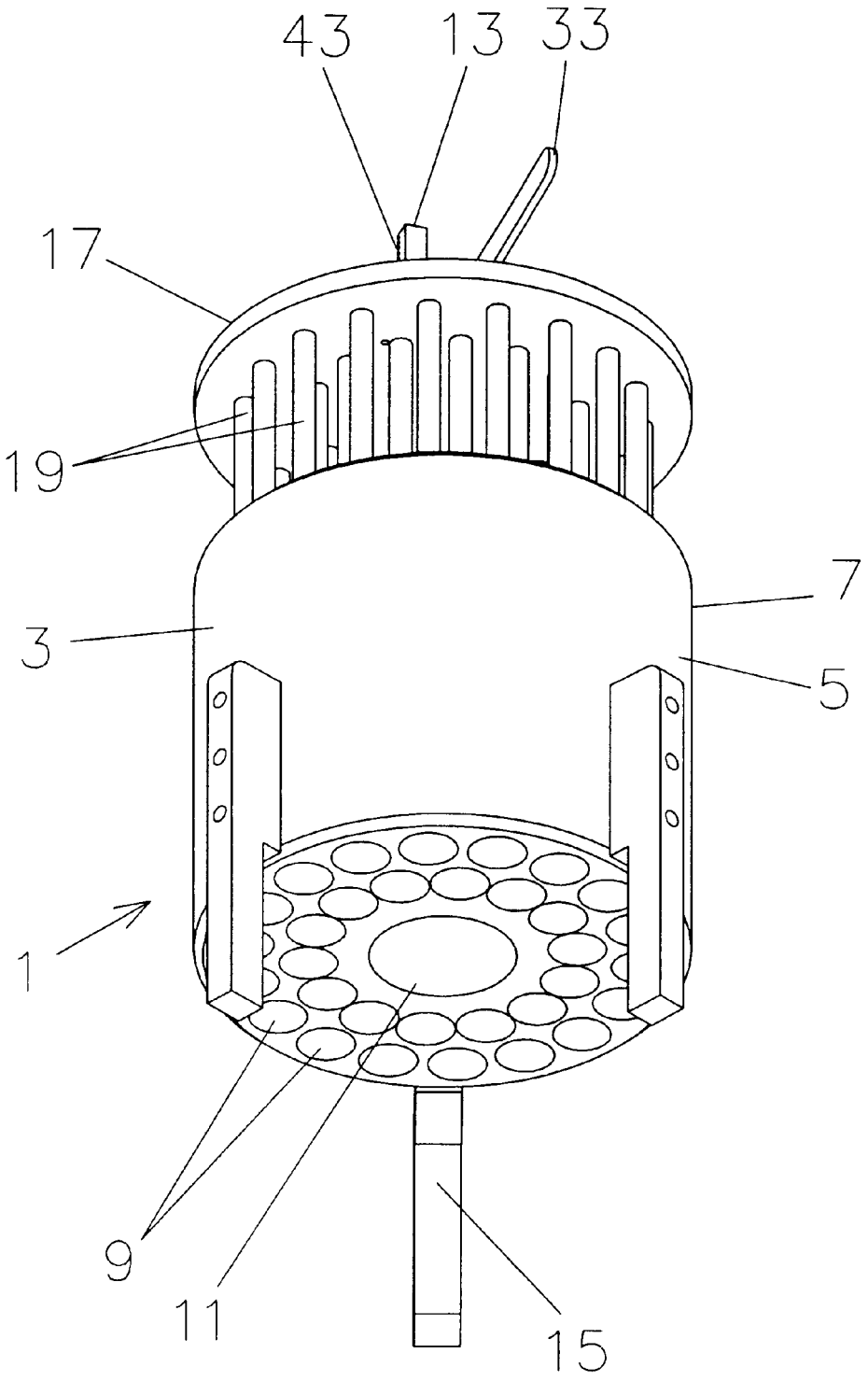
FIG. 4A shows an angular, bottom isometric view of the container dispensing apparatus of the container and liquid dispensing apparatus of FIG. 1.

The housing 3 is supported by and held up by the upright legs 15 that are attached to or are extensions of the peripheral wall 7 of the housing 3. (Please refer to FIG. 4A.) The upright legs 15 may be attached by any regular attachment means such as screw, bolts or nuts. In a preferred embodiment, three upright legs 15 are used, with two upright legs 15 being positioned at a closer angle to one another and a third upright leg 15 being positioned at a larger angle in relationship to both upright legs 15, such that removal of a receptacle 51 that is filled with containers 63 is not obstructed by the upright legs 15. Meanwhile, the two closely-positioned upright legs 15 have to be positioned at an angle, in relationship to one another, that provides lining up of the receptacle 51. The receptacle 51 is pulled against the two closely-positioned upright legs 15, in the direction of the handle 33 when the handle 33 is extending rightward. Preferably, a mark on one of the upright legs 15 serves as a sign with which the receptacle 51 is aligned to ensure exact placement of containers 63 from the container dispensing apparatus 1 into the receptacle 51. In the present invention, the receptacle 51 has a line-up notch in its rim that is lined up with an edge of one of the upright legs 15. Thus, the receptacle 51 receives all containers 63 that are dispensed from the container dispensing apparatus 1. Even more importantly, the containers 63 are dispensed in exactly desired positions on the receptacle 51.

The block 5 which forms the housing 3 is preferably cylindrical and has a central axis. (Please refer to FIG. 2A.) Thus, in a preferred embodiment the peripheral wall 7 is cylindrical. In a preferred embodiment, the housing 3 has groups of internal, axial bores 9 arranged circumferentially about the central axis of the block 5 at a predetermined radius for receiving a succession of articles such as containers 63 for beverages. Successive internal, axial bores 9 are indexed about the central axis. In a preferred embodiment, the internal, axial bores 9 are separated from neighboring internal, axial bores 9, of a larger or smaller diameter, by an equal angle. Each internal, axial bore 9 is adapted to receive and hold a nested column of containers. Each container 63 includes a generally cylindrical side wall, a bottom and an upwardly disposed circular flange or rim. In such a nested column of containers, one container 63 fits within another container such that a large number of containers can be provided in a stacked array. This arrangement limits the space required to configure the container dispensing apparatus 1, which in turn allows columns of containers to be dispensed very close together. This configuration helps to minimize space requirements of the container dispensing apparatus 1 which in turn makes it possible to dispense tightly-spaced columns of containers. Most preferably, the number of downwardly extending rods 19 are positioned so that they lower and raise along a line parallel to the direction of movement of the containers 63. Containers 63 are deposited or dropped individually from the nested column of containers into the receptacle 51, with bottommost container 63 being deposited onto a desired position on the receptacle 51. This positioning helps to further limit the space requirements of the container dispensing apparatus 1. The internal, axial bores 9 may be larger in diameter than the container 63, except for a bottom section of the internal, axial bore 9. Each internal, axial bore 9 is preferably somewhat wider than the corresponding nested column of containers, but not overly so. In this way, the corresponding nested column of containers will be held in a reasonably stable fashion, but the diameter of the corresponding internal, axial bore 9 will still be large enough to allow for easy loading and quick replenishment of the corresponding nested column of containers. In the bottom section of the internal, axial bore 9, for at least one-half inch (½"), the internal, axial bores 9 must be smaller in diameter (i.e. tighter) than the container 63 to ensure that the container 63 will not freely drop from the internal, axial bore 9. For each nested column of containers, the containers 63 are discharged in sequence by a downwardly extending rod 19 running through the corresponding internal, axial bore 9 toward bottom of the corresponding internal, axial bore 9. The shape of each internal, axial bore 9 should approximately reflect the shape of each nested column of containers. It is most preferable that the configuration of the internal, axial bores 9 also includes enough free space to allow for handling of containers 63 of various dimensions. The internal, axial bores 9 may be constructed for use with many different sizes and numbers of different containers 63, and with enough free space to handle containers 63 of slightly varying dimensions.

To assist in controlling drop of the containers 63, at least three relatively flexible strips (not shown), such as plastic strips, can be attached to (e.g. tacked on, screwed on or glued onto) bottom of the housing 3 around bottom of each internal, axial bore 9. Thus, the nested column of containers is supported by the relatively flexible strips, with the relatively flexible strips supporting bottom of bottommost container 63 in the nested column of containers. Although the relatively flexible strips are sufficiently strong to support the container 63, the relatively flexible strips are sufficiently flexible to allow fall of the container 63 with minimal movement of the container 63 when desired. Such relatively flexible strips must be sufficiently strong for the particular size and type of container 63 that the strips are to be supporting. Thus, the entire weight of the nested column of containers is supported by the bottom of the bottommost container 63, with the weight diminishing progressively as the containers 63 are dispensed and height of the nested column of containers diminishes. It should also be noted that, in addition to the continuous weight of the nested column of containers upon the bottommost container 63 and upon any relatively flexible strips when the nested column of containers is in position for dispensing containers 63, when a nested column of containers is moved from storage into the container dispensing apparatus 1, the nested column of containers may fall a small distance. Fall of the nested column of containers may result in an impact load on the bottommost container 63. However, such an impact load on the bottommost container 63 does not normally create a problem because the containers 63 are of light weight and the relatively flexible strips are of sufficient strength to be able to withstand both the continuous stacking loads, as well as the instantaneous impact loads.

Another option is to use an array of tubing of rigid plastic held together, instead of using a housing 3 with internal, axial bores 9.

The cover 17 for the housing 3 preferably consists of a disc. (Please refer to FIGS. 1A and 2A.) The cover 17 has a number of holes in the disc, with each downwardly extending rod 19 being based in and extending downwardly and outwardly from a hole in the cover 17, that the number of holes in the disc is greater than the number of downwardly extending rods 19. The housing 3 must have a number of internal, axial bores 9 that is at least as many as the number of the downwardly extending rods 19 of the cover 17, since each downwardly extending rod 19 of the cover 17 is positioned within an internal, axial bore 9 of the housing 3. The downwardly extending rods 19 of the cover 17 extend from the cover 17 to an uppermost container 63 of any nested column of containers that has the larger number of containers 63 and, thus, the longest and highest nested column of containers. The downwardly extending rods 19 are preferably all of one length and, thus, the downwardly extending rods 19 are stopped at level of the uppermost container 63 of any nested column of containers. Therefore, the cover 17 is self-aligning over the downwardly extending rods 19 and above any nested columns of containers and internal, axial bores 9 of the housing 3. Loading containers 63 in the internal, axial bores 9 of the housing 3 requires a lift-up of the cover 17 after releasing adjustable screw set 31 of adjustable friction pad 25 of cover 17. The vertical bar 13 is preferably of a length to require the removal of the cover 17 from the vertical bar 13 to allow loading of containers 63 into the internal, axial bores 9. However, the cover 17 is self-aligning after the number of downwardly extending rods 19 are positioned in the internal, axial bores 9 of the housing 3. Approximately 50 receptacles 51 can be loaded in about 7–8 minutes by using the container dispensing apparatus 1, thus increasing the speed for loading of receptacles 51 by containers 63 multi-fold when compared with such operation by hand.

The downwardly extending, central pipe 21 of the cover 17 provides alignment for the cover 17. The role of the downwardly extending, central pipe 21 is to minimize twiddling of the cover 17 and, thus, twiddling of the number of downwardly extending rods 19.

Figure 1A:
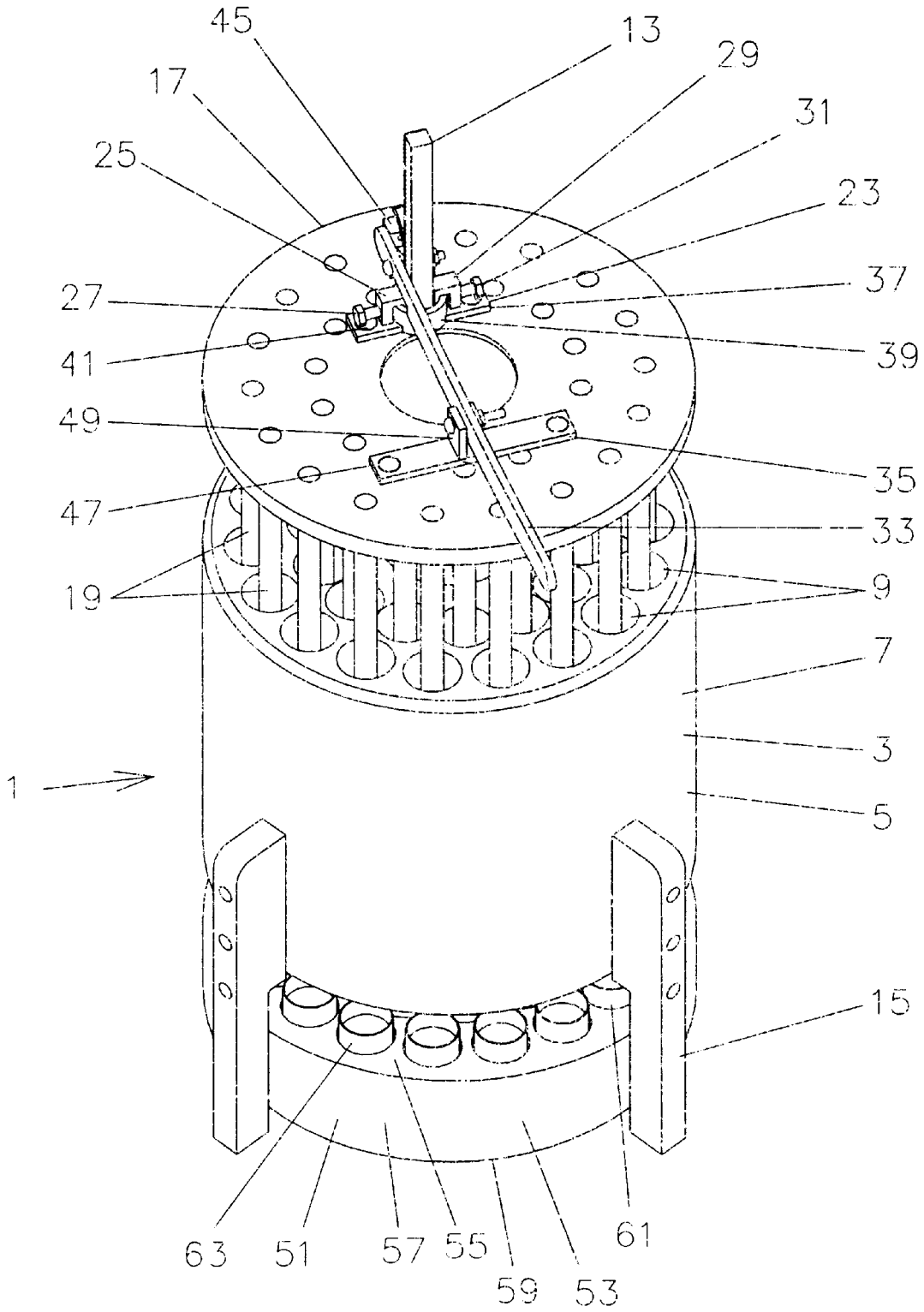
FIG. 1A shows an isometric view of the container dispensing apparatus of the container and liquid dispensing apparatus, along with the receptacle of containers, of FIG. 1.

The vertical bar 13, that is attached to and uprises from the housing 3, protrudes through the cover 17 and, therefrom, through the guide 23 for the vertical bar 13 (as shown in FIG. 1A). The guide 23 for the vertical bar 13 comprises a pair of horizontal sides 37 and a middle tubular body 39 connecting the two horizontal sides 37 (refer to FIGS. 1A and 2A). The two horizontal sides 37 of the guide 23 for the vertical bar 13 are attached by holding means 41 (e.g. preferably screws) to top of the cover 17, thus keeping the guide 23 for the vertical bar 13 motionless during movement of the cover 17. The middle tubular body 39 has a central opening and can be of any height and thickness, as long as the fixed friction pads 25 and the adjustable friction pads 29 are adjusted in height and thickness to correspond to the height and thickness of the middle tubular body 39 of the guide 23 for the vertical bar 13. The guide 23 for the vertical bar 13 is separated from the vertical bar 13 via the fixed friction pad 25 and the adjustable friction pad 29 that are positioned on opposite sides of the vertical bar 13. The guide 23 for the vertical bar 13 is preferably attached (e.g. screwed) to the cover 17 before the vertical bar 13 is passed through the guide 23. However, the fixed friction pad 25 is first fixed (e.g. the screw of the fixed friction pad 25 is tightened) when the internal, axial bores 9 are refilled by containers 63 and the removed cover 17 is positioned again above the block 5. Thereafter, the fixed friction pad 25 remains fixed and solely the adjustable friction pad 29 is loosened up to allow vertical movement of the cover 17 along the vertical bar 13.

The vertical bar 13 is preferably rectangular. Steel is a desired material for construction of the vertical bar 13 although the housing 3 preferably consists of wood. Serrated notches 43 are embedded in the vertical bar 13. The notches 43 are positioned lengthwise on the vertical bar 13. In addition, the notches 43 are positioned along the vertical bar 13 on a side that is facing neither the fulcrum 35 nor the fixed friction pads 25 nor the adjustable friction pad 29, such that the user can easily move a portion of the handle 33 along the vertical bar 13 without any injuries to the user. On opposite sides of the vertical bar 13, the fixed friction pad 25 and the adjustable friction pad 29 serve as friction brakes with a screw adjustment available on the adjustable friction pad 29 for providing the right amount of friction to hold the cover 17 so as to actuate same.

Figure 5A:
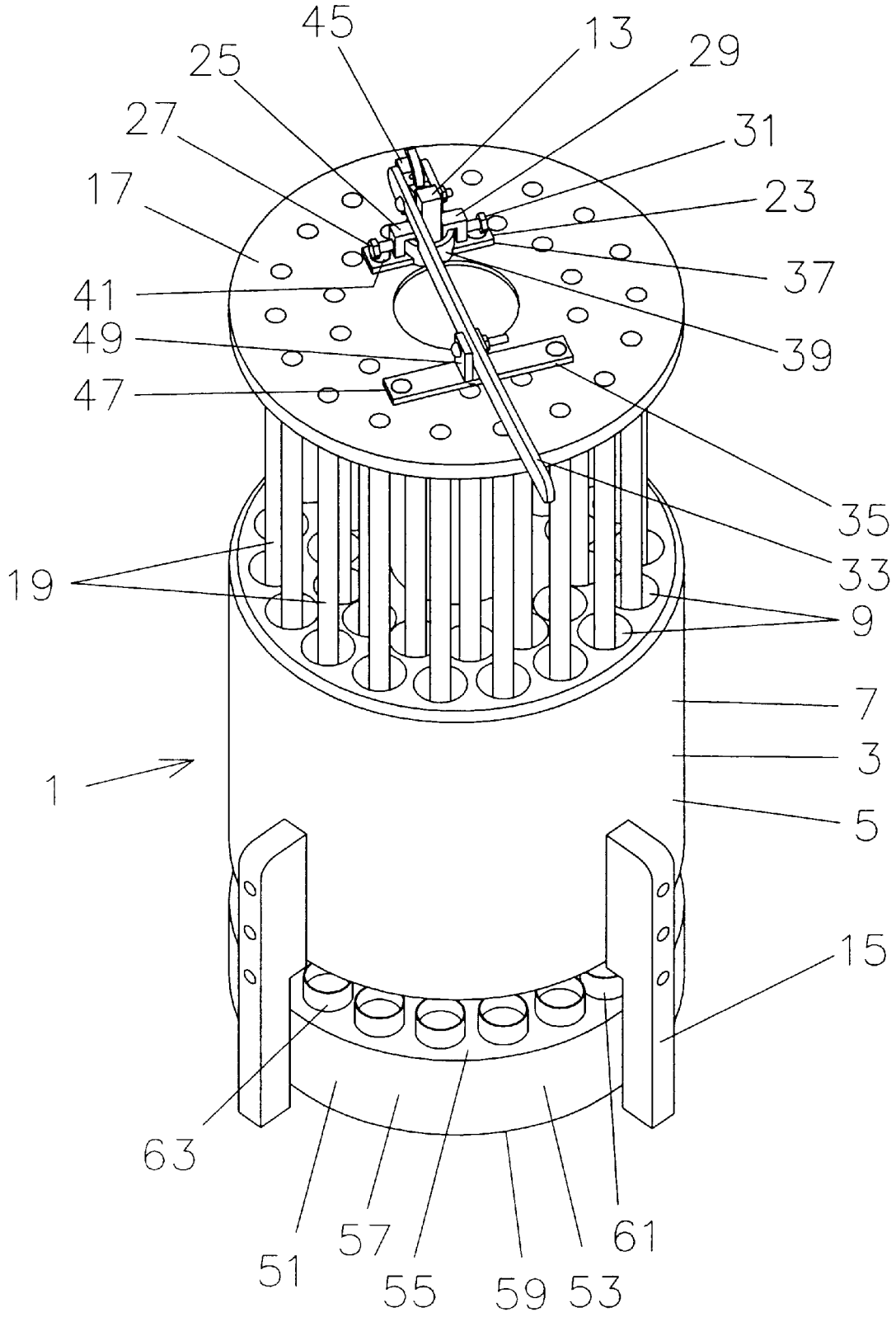
FIG. 5A shows an angular, upper isometric view of the container dispensing apparatus of the container and liquid dispensing apparatus, along with the receptacle of containers, of FIG. 1, having a top plate that is raised during dispension of containers.

The handle 33 comprises a spring-loaded pawl 45 that engages notches 43 in the vertical bar 13. The notches 43 are preferably equally distanced. In a preferred embodiment, the notches 43 are approximately 3/16" apart. Similarly, stacked containers 63 are 3/16" apart. When the handle 33 is moved one notch 43, one container 63 is forced out of each internal, axial bore 9 of the housing 3. Each time that the handle 33 is moved downward, one receptacle 51 can be filled by containers 63. The handle 33 is connected, preferably loosely, to the fulcrum 35 which is affixed to a central portion of the cover 17, either above or adjacent to an opening in the cover 17 for the downwardly extending, central pipe 21, by means of suitable screws (as shown in FIGS. 1A and 5A). The fulcrum 35 has a horizontal base 47 and two parallel vertical walls 49 that extend upwards at center of and from the horizontal base 47 and at a certain distance from one another. The horizontal base 47 of the fulcrum 35 is screwed to the cover 17, while the parallel vertical walls 49 are loosely screwed to the handle 33. The horizontal base 47 of the fulcrum 35 may be attached to the cover 17 before or after the cover 17 is positioned upon the block 5. Similarly, the parallel vertical walls 49 of the fulcrum 35, that has been attached to the cover 17, may be screwed to the handle 33 either after or preferably before the cover 17 is positioned upon the block 5, but, to facilitate set-up, after the guide 23 for the vertical bar 13 is attached to the cover 17 and after the fixed friction pad 25 and the adjustable friction pad 29 are set in their required positions about the vertical bar 13. The distance between the parallel vertical walls 49 of the fulcrum 35 is just large enough to allow an accurate, tight fitting of the handle 33 amidst the parallel vertical walls 49 when the screw is tightened. Thus, when the cover 17 is positioned upon the block 5, the fulcrum 35, the handle 33, the guide 23 for the vertical bar 13, the fixed friction pad 25 and the adjustable friction pad 29 are already attached to their correct positions upon the cover 17 and no further attachments of parts to the cover 17, and to any other part of the container dispensing apparatus 1, are required.

The first step is to put a receptacle 51 under the container dispensing apparatus 1. Then, a nested column of containers is to be put into each desired hollow internal, axial bore 9 of the block 5 when the cover 17, along with the number of downwardly extending rods 19 of the cover 17, have been completely removed from the block 5. When the nested column of containers are exerted into each corresponding internal, axial bore 9, no downwardly extending rod 19 is blocking the passage of the nested column of containers which slides to extreme bottom of the corresponding internal, axial bore 9. Then, each downwardly extending rod 19 is positioned upon the corresponding nested column of containers such that the cover 17 rests twiddleless and stable above the block 5 of the container dispensing apparatus 1. Meanwhile, the downwardly extending, central pipe 21 is inserted into the central, axial bore 11 of the block 5 in order to maximize stability of operation. Also simultaneously, the vertical bar 13 is passed through an opening in the cover 17 and upward through the guide 23 for the vertical bar 13, such that the vertical bar 13 extends above and perpendicularly to the cover 17. To hold the cover 17 stably above the block 5, the fixed friction pad 25 and the adjustable friction pad 29, when fixed, act as brakes. The fixed friction pad 25 is screwed tightly to constantly hold the guide 23 for the vertical bar 13 against the vertical bar 13 and to constantly act as a brake. The adjustable friction pad 29 is screwed tightly when acting as a brake. Therefore, when the adjustable friction pad 29 acts as a brake, the cover 17 is fixed at a stable position. In order to hold the cover 17 at a stable position, the adjustable friction pad 29 is tightened against the vertical bar 13 and against the guide 23 for the vertical bar 13 such that the adjustable friction pad 29 acts as a brake for movement of the cover 17 and movement of all items attached to the cover 17. The adjustable friction pad 29 is tightened by tightening a corresponding holding means 41, such as a screw, that is used to adjust positioning of the adjustable friction pad 29. One corresponding holding means 41, such as a screw, remains constantly tightened upon the fixed friction pad 25 which remains constantly fixed. However, the screw of the adjustable friction pad 29 may be loosened to allow vertical movement of the cover 17 along the vertical bar 13. Meanwhile, the handle 33 is positioned amidst and screwed to the parallel vertical walls 49 of the fulcrum 35, but is loose enough to allow movement of the handle 33 up and down along the vertical bar 13 such that the spring-loaded pawl 45 engages with different notches 43 on the vertical bar 13 as the cover 17 moves gradually downwards.

If it is desired to raise or lower the cover 17, the adjustable friction pad 29 is loosened by loosening its corresponding holding means 41. (Please refer to FIG. 1A.) When its corresponding holding means 41 is loosened, a space is created between the adjustable friction pad 29 and the vertical bar 13 and the cover 17 can be moved vertically relatively easily. Where the desired level is reached, the holding means 41 is tightened such that the adjustable friction pad 29 is tightened and such that the cover 17 is again fixed at one position. The handle 33 is ready for operation, with the spring-loaded pawl 45 of the handle 33 being engaged with notches 43 in the vertical bar 13. At this point, put thumb on the spring-loaded pawl 45 to raise the spring-loaded pawl 45 and to separate the spring-loaded pawl 45 from the notch 43 of the vertical bar 13. While holding the spring-loaded pawl 45 open, grasp the handle 33 by the other hand and raise the cover 17. The cover 17 is moved vertically along the vertical bar 13. When the cover 17 has reached the desired position, release the spring-loaded pawl 45. Preferably, the spring-loaded pawl 45 is moved notch 43 by notch 43 to deposit the containers 63 one by one, since the notches 43 are designed to be sized according to container measurements. The spring-loaded pawl 45 normally maintains the handle 33 with the vertical bar 13 except during the downward motion of the cover 17, of the downwardly extending rods 19 and of the containers 63. Linkage of the spring-loaded pawl 45 of the handle 33 with the vertical bar 13 and of the handle 33 and of the vertical bar 13 with the cover 17 imparts a corresponding downward movement to the spring-loaded pawl 45 and to the cover 17 in synchronism with the motion of the handle 33. Lowering of the cover 17 by a "notch 43" standard implies a descent of the number of downwardly extending rods 19 by a "notch 43" standard so as to separate the bottommost container 63 from the remaining containers 63 in the nested column of containers. If the notches 43 are designed specifically for containers 63 of a particular size, for each notch 43 that a downwardly extending rod 19 is lowered, the bottommost container 63 of the corresponding nested column of containers is discharged from bottom of the corresponding internal, axial bore 9. Moving the handle 33 upwards, lowers the spring-loaded pawl 45 one notch 43 and results in downward movement of the number of downwardly extending rods 19 and disposal of one container 63 out of each internal, axial bore 9, that contains at least one container 63, into a corresponding opening of the receptacle 51. At this point, the adjustable friction pad 29 is reset by resetting the holding means 41 (e.g. the screw) and tightening the adjustable friction pad 29 against the vertical bar 13 and against the guide 23 for the vertical bar 13. Thus, the cover 17, and all items attached to the cover 17, are fixed in relation to the vertical bar 13. At this stage, the number of downwardly extending rods 19 are directly exerting force on the containers 63. When the handle 33 is moved downward, each downwardly extending rod 19 is forced to push an underlying container 63 out. Logically, the number of notches 43 on the vertical bar 13 must be at most equal to the maximum number of containers 63 that may fit in any internal, axial bore 9 of the housing 3. Therefore, each time the spring-loaded pawl 45 of the handle 33 is moved down one notch 43 on the vertical bar 13, each nested column of containers of the internal, axial bores 9 loses one container 63, the downwardly extending rods 19, the downwardly extending, central pipe 21 and the cover 17 move lower and the receptacle 51 receives containers 63 from the internal, axial bores 9. At that point, each container 63 which had previously been a second-from-bottom container 63 becomes the bottommost container 63 every time when the spring-loaded pawl 45 of the handle 33 is moved down one notch 43 on the vertical bar 13. In a preferred embodiment, the distance between the cover 17 and top of the housing 3 is basically equal to the length of the longest nested column of containers. Thus, when the longest nested column of containers is disposed from the corresponding internal, axial bore 9, the cover 17 reaches top of the housing 3 and rests on the housing 3 and the number of downwardly extending rods 19 protrude completely into the corresponding internal, axial bores 9 and rest therein.

When the cover 17 is positioned above the block 5, each downwardly extending rod 19 exerts pressure upon a corresponding nested column of containers as soon as the downwardly extending rod 19 reaches that corresponding nested column of containers. The distance between centers of adjacent containers 63 corresponds to the distance between centers of adjacent internal, axial bores 9 and, preferably, adjacent downwardly extending rods 19. Of course, if the cover 17 twiddles, the distance between adjacent downwardly extending rods 19 changes. If all downwardly extending rods 19 are of equal length, the downward motion of the handle 33 automatically positions bottom end of the downwardly extending rods 19 into alignment with uppermost container 63 of the longest nested column of containers so that axial movement of the downwardly extending rods 19 is restrained only by the longest nested column of containers. Upon exertion of downward pushes on the handle 33, the cover 17 and, therefore, each downwardly extending rod 19 descends, hits each uppermost container 63 of the corresponding nested column of containers, moves the corresponding nested column of containers downwards through the internal, axial bore 9 and, thereby, discharges containers 63 one-by-one from bottom of the internal, axial bore 9. The discharged container 63 is received in a receptacle 51 with openings that correspond in numbering and position exactly to the internal, axial bores 9 and in size at least a little larger than bottom of the containers 63, allowing each container 63 to collapse into and rest motionless in a corresponding opening of the receptacle 51. The bottommost containers 63 are preferably positioned fairly near (i.e. not too far above) the receptacle 51. In this way, once the bottommost container 63 is freed from the nested column of containers, the container 63 will drop down a short distance and fit itself into alignment with the other containers 63 deposited within the receptacle 51.

Although the internal, axial bores 9 may be of various lengths and the number of downwardly extending rods 19 may be of various lengths, in a preferred embodiment all internal, axial bores 9 are of the same length and the number of downwardly extending rods 19 are of equal length. In addition, preferably all internal, axial bores 9 are as long as the number of downwardly extending rods 19 and the downwardly extending, central pipe 21 is as long as the central, axial bore 11 such that when all containers 63 are ejected, the number of downwardly extending rods 19 rest completely within the corresponding internal, axial bore 9 and the downwardly extending, central pipe 21 rests completely within the central, axial bore 11.

Therefore, if the internal, axial bores 9 are each filled with a nested column of containers, when the cover 17 is appropriately adjusted, each upward movement of the handle 33 causes a lowering of the spring-loaded pawl 45 and each downward movement of the handle 33 results in filling up of a receptacle 51 with containers 63. During each downward movement of the handle 33, the lowermost container 63 is deposited from each internal, axial bore 9 of the block 5 into each corresponding opening in the receptacle 51. As soon as the receptacle 51 is filled, the receptacle 51 is moved and is replaced by a new receptacle 51 to present a new series of openings for the containers 63 that are disposed by the block 5. In this way, the receptacle 51 is loaded with containers 63 in a systematic co-ordinate fashion, and since the propelled containers 63 are moved immediately under the liquid dispensing apparatus 2 upon their receipt within the receptacle 51, the containers 63 may be filled with liquid as fast as the movement of the handle 33 operations can proceed until the containers 63 in the housing 3 of the container dispensing apparatus 1 are completely dispensed.

Therefore, the container dispensing apparatus 1 allows quick and easy loading of containers 63 into receptacles 51. As is obvious, extremely little manual labor is required to utilize the container dispensing apparatus 1. Primarily, the user needs to only ascertain that a sufficient nested column of containers is maintained within each internal, axial bore 9. In this regard, the vertical orientation of the internal, axial bores 9 assists the user by allowing the user to put a large column of containers in each internal, axial bore 9 at a time.

Figure 2B:
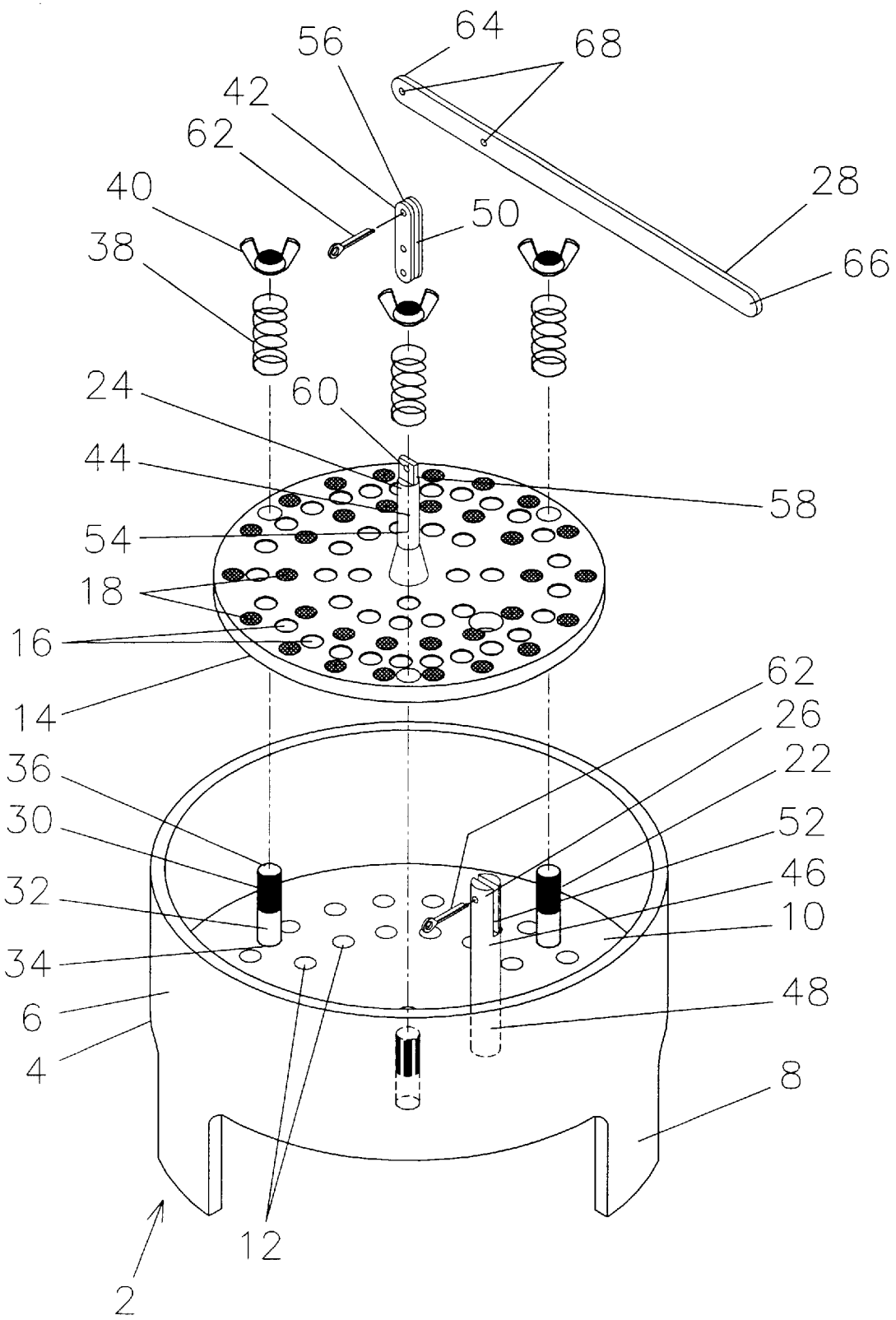
FIG. 2B shows an exploded isometric view of the liquid dispensing apparatus of the container and liquid dispensing apparatus of FIG. 1.
Figure 3:
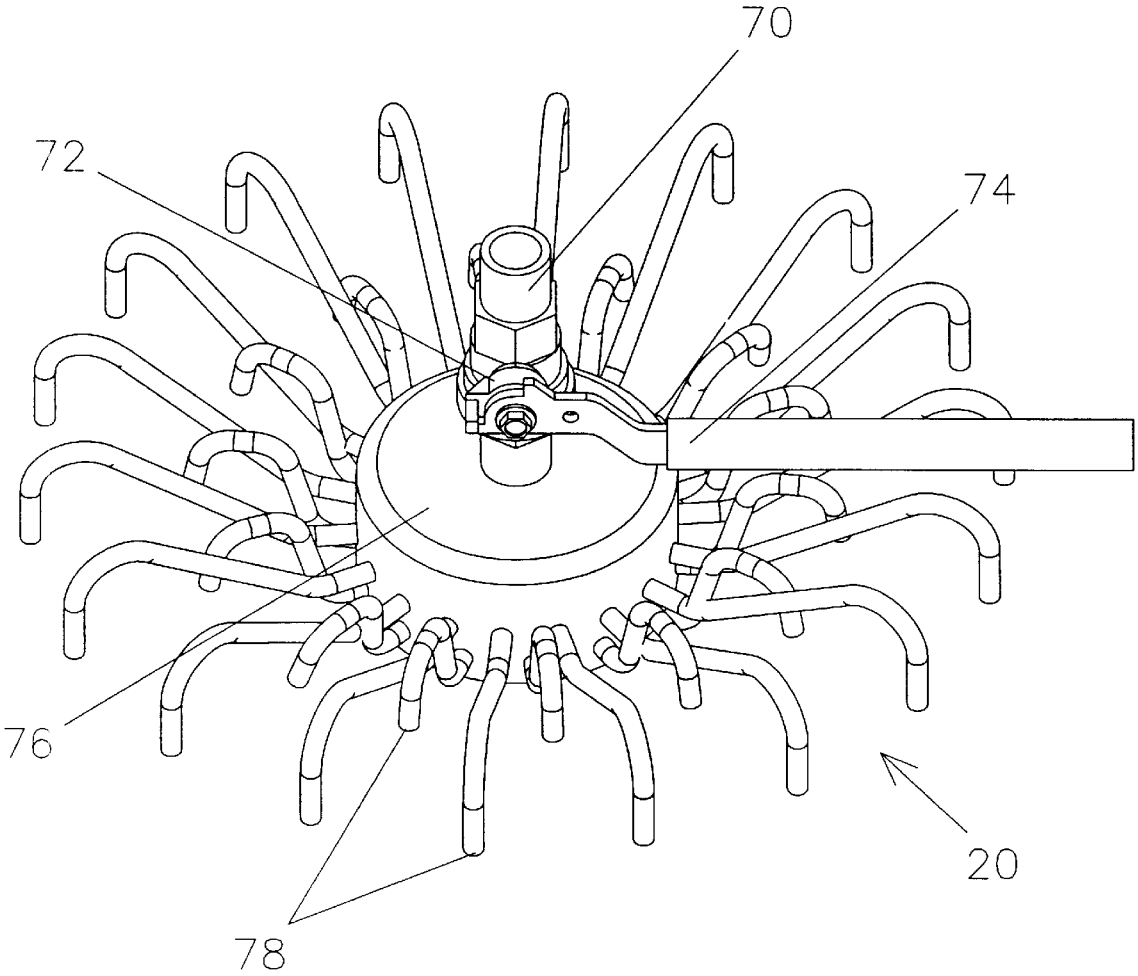
FIG. 3 shows an isometric view of a separable dispenser for the liquid dispensing apparatus of the container and liquid dispensing apparatus of FIG. 1.
Figure 4B:
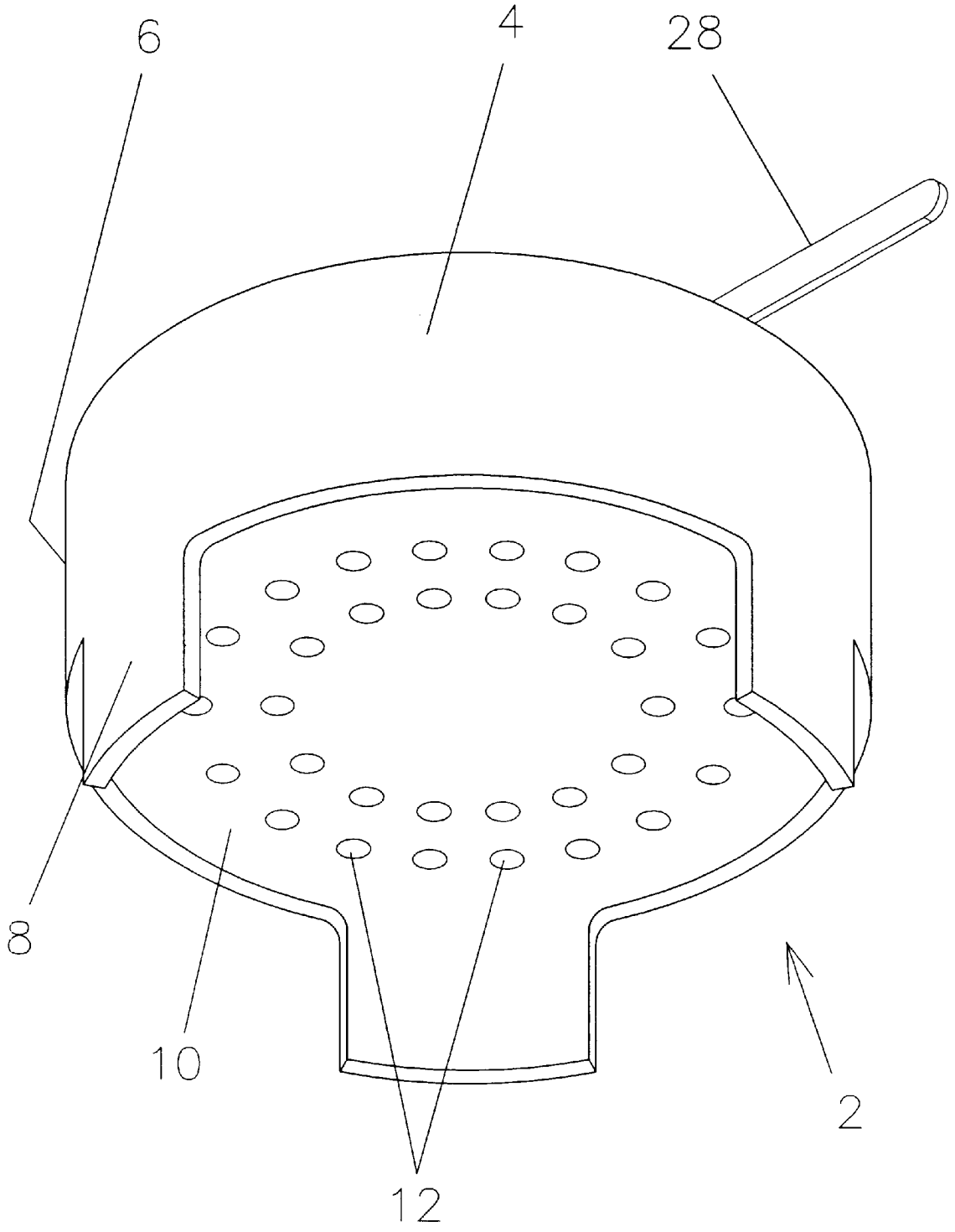
FIG. 4B shows an angular, bottom isometric view of the liquid dispensing apparatus of the container and liquid dispensing apparatus of FIG. 1.
Figure 4C:
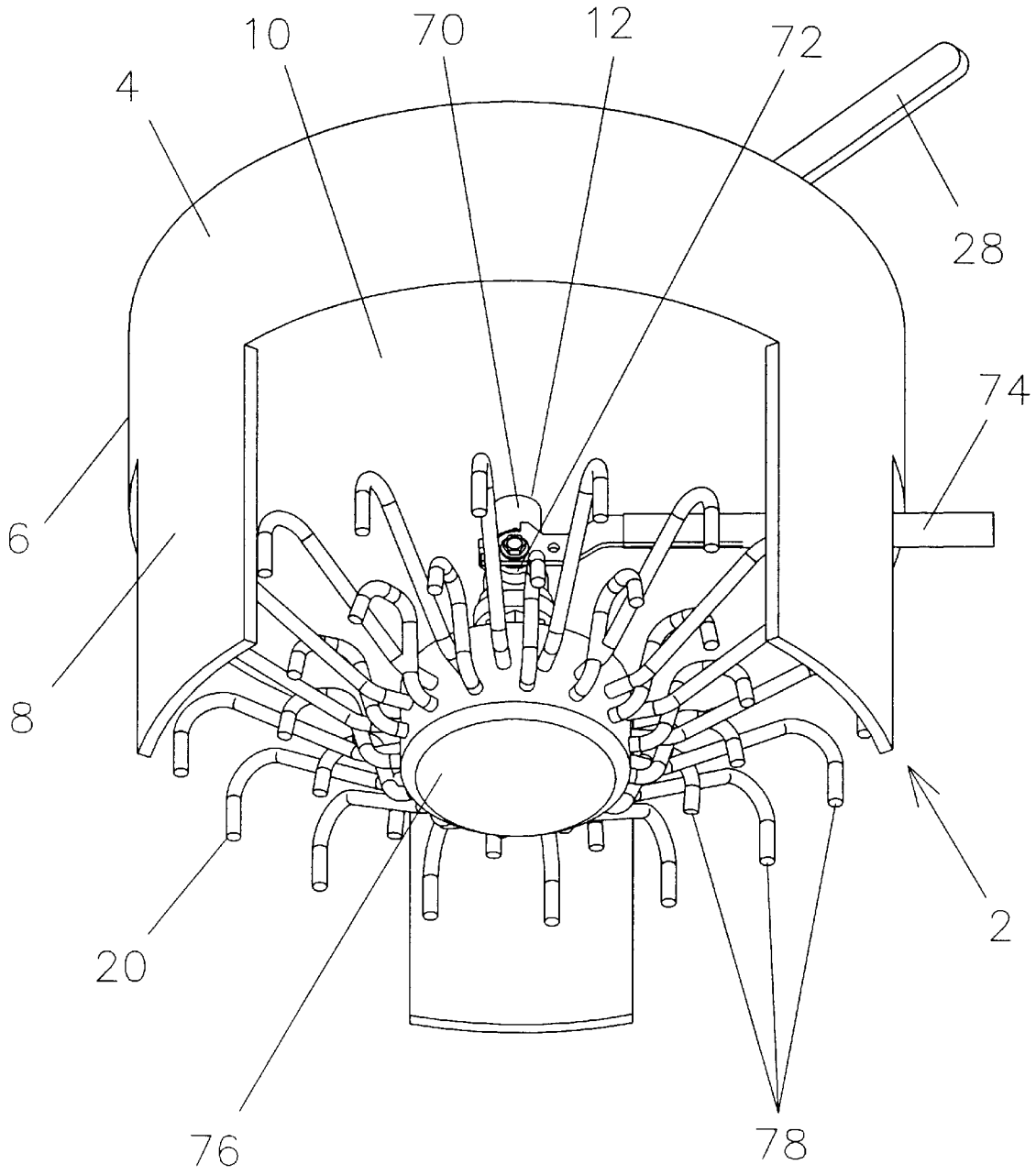
FIG. 4C shows an angular, bottom isometric view of the liquid dispensing apparatus of the container and liquid dispensing apparatus of FIG. 1, upon attachment of the separable dispenser to a liquid dispensing opening of bottom wall of the liquid dispensing apparatus.

A housing 4 for the liquid dispensing apparatus 2 comprises a side wall 6 and a bottom wall 10. (Please refer to FIG. 2B.) The housing 4 is mounted on at least three upright stands 8 (as shown in FIG. 4B). The bottom wall 10 of the housing 4 is provided with a number of openings (referred to hereafter as "number of liquid dispensing openings 12") through which the liquid may be dispensed. The number of liquid dispensing openings 12 of the bottom wall 10 are selectively positioned for dispensing liquids into a plurality of containers 63 located below the bottom wall 10. A plate 14 with liquid dispensing openings 16 is positioned upon the bottom wall 10 of the housing 4. In order to prevent flow of liquid through the number of liquid dispensing openings 12 of the bottom wall 10 before the plate 14 is raised, rubber-like inserts 18 are used at end of some liquid dispensing openings 16 of the plate 14 that correspond to and lie above the number of liquid dispensing openings 12 of the bottom wall 10. The rubber-like inserts 18, that are used at end of some liquid dispensing openings 16 of the plate 14, are preferably made of wood or plastic. However, some liquid dispensing openings 16 in the plate 14, that are not positioned above the number of liquid dispensing openings 12 of the bottom wall 10, are not blocked and remain open at all times. When the plate 14 rests over the bottom wall 10, any liquid that passes through the liquid dispensing openings 16 of the plate 14 is stopped by the bottom wall 10 and does not reach the number of liquid dispensing openings 12 of the bottom wall 10. A spider-like dispenser 20 (as shown in FIGS. 3 and 4C) may be used as a replacement for the number of liquid dispensing openings 12 of the bottom wall 10 of the housing 4 for the liquid dispensing apparatus 2. The liquid dispensing openings 16 of the plate 14 are retained away from the number of liquid dispensing openings 12 and above surfaces of the bottom wall 10, without twiddling, by positioning the plate 14 through some upright bars 22. In a preferred embodiment, at least three upright bars 22 are attached to the bottom wall 10 of the liquid dispensing apparatus 2. By raising the plate 14 along the upright bars 22 when setting up the liquid dispensing apparatus 2 and by raising and lowering the plate 14 along the upright bars 22, the direction of movement of the plate 14 is stable and there is basically no twiddling of the plate 14. Attached to the plate 14 is a primary vertical support 24. A secondary vertical support 26 is attached to the bottom wall 10. A lever 28 runs between and connects the primary vertical support 24 to the secondary vertical support 26 and serves to raise the plate 14. The lever 28 is removably attached to the primary vertical support 24 and to the secondary vertical support 26.

The side wall 6 is preferably cylindrical in shape. (Please refer to FIG. 1B.) In a preferred embodiment, the side wall 6 consists of a generally cylindrical wall of plastic, parts of which are extensions of the upright stands 8. However, the side wall 6 may have any shape. A cylindrical shape for the side wall 6 is preferred for several reasons including simpler and more economical manufacturing, conservation of material and smoother movement of the plate 14 inside the housing 4 due to lack of any angles and a smaller surface area when compared to some other three-dimensional structures, such as cubes.

Figure 1B:
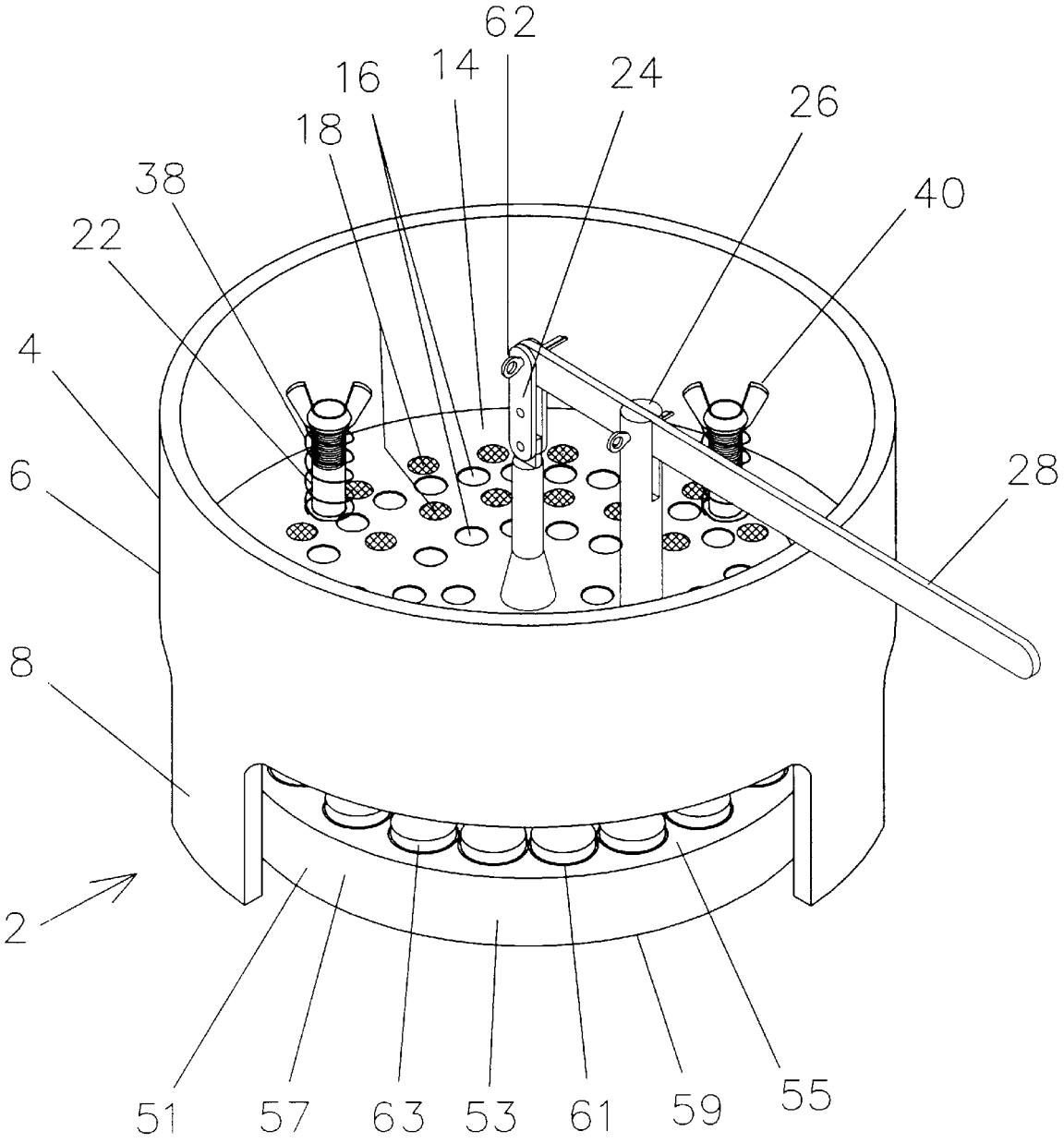
FIG. 1B shows an isometric view of the liquid dispensing apparatus of the container and liquid dispensing apparatus, along with the receptacle of containers, of FIG. 1.

The housing 4 has an open top for receiving liquid at any time, even while liquid is being poured by the liquid dispensing apparatus 2 into the plurality of containers 63 (as shown in FIG. 1B). Of course, a cover (not shown) can be used for keeping the liquid in the liquid dispensing apparatus 2 clean while the liquid dispensing apparatus 2 is not being used.

The bottom wall 10 of the housing 4 is provided with the number of liquid dispensing openings 12 (shown in FIG. 2B) which are suitably positioned to dispense liquid into a plurality of containers 63 that are optionally located below the bottom wall 10. Such containers 63 are preferably located below the bottom wall 10 in a container receptacle 51. With the containers 63 being located right below the number of liquid dispensing openings 12 of the bottom wall 10 of the liquid dispensing apparatus 2, there is no need for conduits passing from the housing 4 to the containers 63. This is a great advantage over previously existing system where numerous transfer lines and conduits were needed to assign the path of transfer of liquid. For example, in U.S. Pat. No. 4,512,377, conduits passing from the beer kegs pass through the wall duct into the housing 4 interior and run to the beverage dispensing openings (col. 3, lines 29–32). In the liquid dispensing apparatus 2, the arrangement of the bottom wall 10 of the housing 4 and the plate 14 above the bottom wall 10, along with a matching placement of the containers 63 with the number of liquid dispensing openings 12 of the bottom wall 10, dismiss the need, and therefore the expenses, for any conduits between the housing 4 and the containers 63.

Different versions of receptacles 51 for containers 63, with matching containers 63, may be used with the present invention. Such receptacles 51, along with their matching containers 63, are presently available in the market and can be purchased at a reasonable price to be used along with the present invention. The receptacles 51 for containers 63 that are used with the present invention generally comprise a receptacle housing 53 and a top surface 55. (Please refer to FIGS. 1A, 1B, 5A and 5B.) The receptacle housing 53 preferably consists of a cylindrical side wall 57 and a bottom wall 59. The top surface 55 has liquid dispensing openings 61 that should preferably correspond to the number of liquid dispensing openings 12 of the bottom wall 10 of the liquid dispensing apparatus 2. The containers 63 are positioned in the liquid dispensing openings 61 of the top surface 55 of the receptacle 51. In a preferred embodiment, the number and location of the containers 63 in the receptacles 51 are selected to correspond to the number and location of the number of liquid dispensing openings 12 in the bottom wall 10 of the housing 4 of the liquid dispensing apparatus 2. However, a lower number of containers 63 may be used, depending upon the number of individuals to be served. The number of containers 63 provided with liquid may be readily and easily increased or decreased as desired to meet the changing needs of a dispensing establishment simply by adding or removing one or more of the containers 63 which are a part of the receptacle 51 of containers 63, based upon the number of liquid dispensing openings 12 in the bottom wall 10 of the housing 4 that remain open. Any number of liquid dispensing openings 12 in the bottom wall 10 of the housing 4 that are desired to be closed, can be pegged.

At least three upright stands 8 (as shown in FIG. 4B) are needed for supporting and providing sufficient stability for the housing 4 for the liquid dispensing apparatus 2. In a preferred embodiment, the upright stands 8 are extensions of the side wall 6 of the housing 4 for the liquid dispensing apparatus 2. The upright stands 8 are preferably perpendicular to and extend downwardly from the side wall 6. Although higher expenses would be incurred, there is an option of using upright stands 8 that are separately and removably attached to the housing 4. However, the expenses of producing liquid dispensing apparatus 2 using removably attached upright stands 8 are sufficiently higher to most probably result in deletion of the removably attached upright stands 8 as a practical option.

Of course, the larger is the number of upright stands 8, a larger amount of support is provided for the housing 4. However, the larger is the amount of support, a larger amount of material is needed for constructing the liquid dispensing apparatus 2 and, therefore, the more expensive is the liquid dispensing apparatus 2. Thus, in order to keep a balance between a maximum support and a minimum expense, the most preferred number of upright stands 8 is three. In a preferred embodiment, three upright stands 8 are used as extensions of the side wall 6 to support the housing 4. In addition, there is a maximal limit to the number of upright stands 8 since there should be sufficient space between at least two upright stands 8 to allow passage of the receptacle 51 to and from under the housing 4 for the liquid dispensing apparatus 2.

Figure 5B:
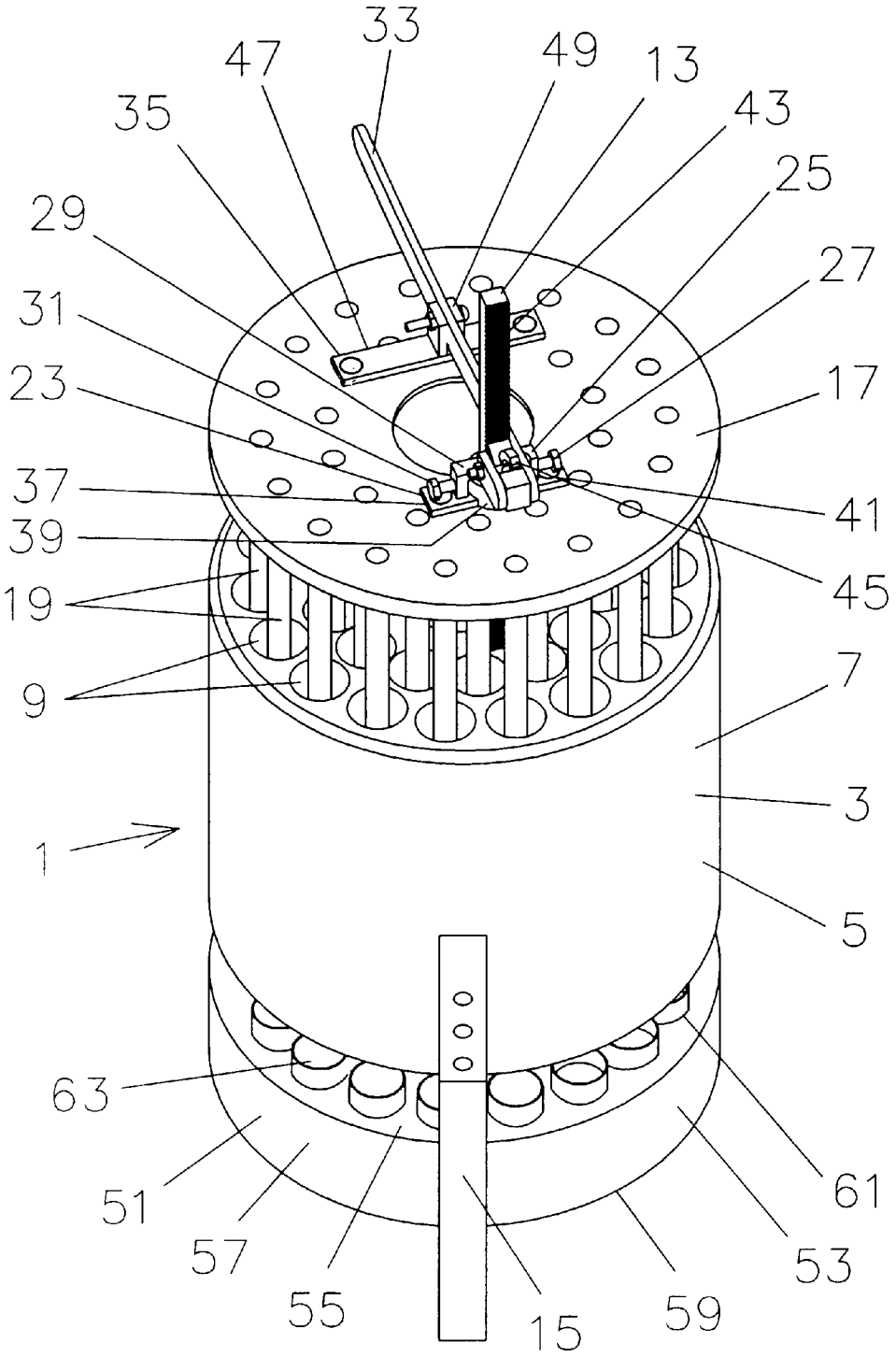
FIG. 5B shows an angular, upper isometric view of the container dispensing apparatus of the container and liquid dispensing apparatus, along with the receptacle of containers, of FIG. 1, having a top plate that is raised during dispension of containers.

For choosing the number of upright bars 22, a logic similar to the logic used for choosing the number of upright stands 8 can be applied. At least three upright bars 22 are used for providing sufficient stability of direction of movement of the plate 14 (as shown in FIGS. 2B and 5B). In a preferred embodiment, the upright bars 22 are irremovably attached to the bottom wall 10. Although higher expenses would be incurred, there is an option of using upright bars 22 that are separately and removably attached to the bottom wall 10 of the housing 4. However, the expenses of producing liquid dispensing apparatus using removably attached upright bars 22 are sufficiently higher to most probably result in deletion of removably attached upright bars 22 as a practical option.

Again, a similar logic applies to choosing the number of the upright bars 22 that are attached to the bottom wall 10. The upright bars 22 are perpendicular to and extend upwardly from the bottom wall 10. In a preferred embodiment, at least three upright bars 22 are used to provide sufficient stability of the direction of movement of the plate 14 while the plate 14 is moved upwards and downwards within the side wall 6. A larger number of upright bars 22 provides a larger amount of stability of the direction of movement of the plate 14 while the plate 14 is moving. However, the larger is the amount of stability, a larger amount of material is needed for manufacturing the larger number of upright bars 22 and, therefore, a higher cost is incurred. Thus, in order to keep a balance between a maximum stability in direction of movement of the plate 14 and a minimum expense, the most preferred number of upright bars 22 is three. In a preferred embodiment, three upright bars 22 are used as extensions of the bottom wall 10 to support the plate 14.

Each upright bar 22 comprises an upper section 30, a lower section 32, a lower end 34 and an upper end 36. (Please refer to FIG. 2B.) A spring 38 is positioned around the upper section 30 of the upright bar 22, while the lower section 32 of the upright bar 22 passes through the corresponding liquid dispensing opening 16 of the plate 14 (as shown in FIGS. 1B and 5B). The lower end 34 of the upright bar 22 is attached, either removably or irremovably, to the bottom wall 10. The upper end 36 of each upright bar 22 is closed by an attachment 40 which limits the movement of the spring 38. The attachment 40 to the upper end 36 prevents any further upward movement of the spring 38. Preferably, the attachment 40 consists of a wing nut or a hex nut. However, any attachment 40, such as a cap, that can resist the pressure exerted by the spring 38 during upward movement of the plate 14 may be used. Although of a limited marketability, irremovable attachments 40 may even be used for the upper end 36 of the upright bar 22. If the attachment 40 to the upper end 36 is irremovable, naturally the plate 14 is irremovable and some limitations, such as difficulty in cleaning or repairing the housing 4 of the liquid dispensing apparatus 2, are created.

In a preferred embodiment, the bottom wall 10 of the housing 4 of the liquid dispensing apparatus 2 has only one liquid dispensing opening 12. The spider-like dispenser 20 is connected to the liquid dispensing opening 12 of the bottom wall 10 (as shown in FIG. 4C). The spider-like dispenser 20 comprises a tubular connecting body 70 that is connected internally to the only liquid dispensing opening 12 of the bottom wall 10 of the housing 4, a valve 72 that is positioned in the tubular connecting body 70, a switch 74 (or valve actuator or handle) that is connected to the tubular connecting body 70 for opening and closing the valve 72, a base 76 that is positioned below and that supports the tubular connecting body 70 and that is connected internally to the tubular connecting body 70 and tubes 78 that are arranged in the shape of spider legs (referred to as "spider-leg tubes 78") around the base 76, that exit from the base 76 and that are connected internally to the base 76. In an embodiment that is not shown in the attached figures, the switch 74 is preferably connected by an extension rod (not shown) to the tubular connecting body 70. The extension rod extends from the tubular connecting body 70 to an upright stand 8 and protrudes minutely out of the same upright stand 8. The switch 74 is attached to and extends outwardly from the extension rod at the upright stand 8, such that the upright stand 8 creates a support for the switch 74 of the spider-like dispenser 20. In another embodiment, the extension rod may extend to and be attached to another downward extension of the side wall 6 of the liquid dispenser apparatus 2.

As with the upright bars 22 and the upright stands 8, the secondary vertical support 26 that is attached to the bottom wall 10 may be either removably or irremovably attached to the housing 4. (Please refer to FIG. 2B.) The secondary vertical support 26 is attached to and extends upwardly from the bottom wall 10 of the housing 4. In a preferred embodiment, the secondary vertical support 26 is irremovably attached to the bottom wall 10. Although higher expenses would be incurred, there is an option of separately and removably attaching the secondary vertical support 26 to the bottom wall 10 of the housing 4. However, the expenses of producing liquid dispensing apparatus using the removably attached secondary vertical support 26 is sufficiently higher to most probably result in deletion of the removably attached secondary vertical support 26 as a practical option.

A plate 14 with liquid dispensing openings 2 is positioned upon the bottom wall 10 of the housing 4. (Please refer to FIGS. 2B and 6.) The plate 14 actually serves as a valve. The plate 14 is structured to be about 1" to about 1½" smaller in diameter than the housing 4 of the liquid dispensing apparatus 2, such that only a minor portion of the liquid that reaches the bottom wall 10 is the liquid that passes downwards through the liquid dispensing openings 16 of the plate 14 that are not blocked by any rubber-like inserts 18. A major portion of the liquid that reaches the bottom wall 10 of the housing 10 of the liquid dispensing apparatus 2 flow around edges of the plate 14 and under the plate 14 when the plate 14 is raised. Any liquid positioned under the plate 14 flows upwards through the liquid dispensing openings 16 of the plate 14 and flows upwards from between the side wall 6 of the housing 4 and the edges of the plate 14, such that forceful splashing of the liquid is avoided when the plate 14 falls upon the bottom wall 10 of the housing 4 of the liquid dispensing apparatus 2. (The liquid dispensing openings 16 of the plate 14 that are not blocked are not located above the number of liquid dispensing openings 12 of the bottom wall 10, while the liquid dispensing openings 16 of the plate 14 that are blocked are located above the number of liquid dispensing openings 12 of the bottom wall 10.) In addition, there is control over the liquid that reaches the number of liquid dispensing openings 12 of the bottom wall 10, since the liquid that passes through the liquid dispensing openings 16 of the plate 14 only reaches the number of liquid dispensing openings 12 of the bottom wall 10 when the plate 14 is raised. As a result, there would be control upon the amount of liquid that would be poured into the number of containers 63. Otherwise, any liquid in the housing 4 of the liquid dispensing apparatus 2 will be constantly pouring through any liquid dispensing openings 12 of the bottom wall 10 that are not covered by the plate 14, even when the plate 14 is not raised and even when no containers 63 are provided for the liquid. In a preferred embodiment, the plate 14 is sufficiently large to prevent any flow of liquid through any liquid dispensing openings 12 of the bottom wall 10, but not large enough to prevent flow of liquid between edges of the plate 14 and the side wall 6 of the housing 4 of the liquid dispensing apparatus 2 and to allow smooth movement of the plate 14 up and down within the housing 4.

Since the preferred embodiment of the side wall 6 is cylindrical, the plate 14 is preferably circular in shape. The shape of the plate 14 depends upon the shape of the side wall 6, with the plate 14 being the shape of the cross-section of the side wall 6. As stated previously, other structures of the side wall 6 and, thus, of the plate 14 are possible as well. However, using a circular plate 14 with a cylindrical side wall 6 saves in manufacturing expenses, amount and cost of material, maintenance costs and ease and efficiency of operation.

Some liquid dispensing openings 16 of the plate 14 fall over the number of liquid dispensing openings 12 of the bottom wall 10 when the plate 14 is positioned upon the bottom wall 10. The liquid dispensing openings 16 of the plate 14 that fall over the number of liquid dispensing openings 12 of the bottom wall 10 are plugged by rubber-like inserts 18. However, the liquid dispensing openings 16 of the plate 14 that do not fall on the number of liquid dispensing openings 12 of the bottom wall 10, but in contrast each falls on a part of the bottom wall 10 that does not have a liquid dispensing opening 12 (i.e. on a closed surface of bottom wall 10), do not require a rubber-like insert at their bottom and need not be closed by a rubber-like insert. When the plate 14 rests on the bottom wall 10, each liquid dispensing opening 16 of the plate 14 rests on a closed surface of the bottom wall 10. When the plate 14 rests on the bottom wall 10 of the housing 4 of the liquid dispensing apparatus 2, a portion of the bottom wall 10 that remains uncovered by the plate 14 does not include any liquid dispensing openings 12. Therefore, as long as the plate 14 rests on the bottom wall 10, any liquid that passes through the liquid dispensing openings 16 of the plate 14 is stopped by the closed surface of the bottom wall 10 and simply remains in the housing 4 of the liquid dispensing apparatus 2 until the plate 14 is raised above the bottom wall 10. More importantly, as long as the plate 14 rests on the bottom wall 10, any liquid that flows between edges of the plate 14 and the side wall 6 of the housing 4 of the liquid dispensing apparatus 2 is stopped by the closed surface of the bottom wall 10 and simply remains in the housing 4 until the plate 14 is raised above the bottom wall 10. When the plate 14 is raised above the bottom wall 10, the liquid flows toward and through the number of liquid dispensing openings 12 of the bottom wall 10. The bottom wall 10 of the housing 4 comprises the number of liquid dispensing openings 12 which are suitably positioned to dispense liquid when the plate 14 is raised, while avoiding flow of liquid when the plate 14 rests on the bottom wall 10. A number of liquid dispensing openings 12 of the bottom wall 10 that are central are optionally used for an increased capacity of operation. Such central number of liquid dispensing openings 12 of the bottom wall 10 are closed by pegs when not in use.

The liquid dispensing openings 16 of the plate 14 are retained above the closed surface of the bottom wall 10, without twiddling, by moving the plate 14 along the upright bars 22. By passing the plate 14 upwardly and downwardly along the upright bars 22, the liquid dispensing openings of the plate 14 remain over the closed surface of the bottom wall 10. However, upon passing the plate 14 upwardly along the upright bars 22, a portion of the liquid that is positioned above the plate 14 passes through the liquid dispensing openings 16 of the plate 14 downwards towards the bottom wall 10. Meanwhile, a larger portion of the liquid that is positioned above the plate 14 passes between edges of the plate 14 and the side wall 6 of the housing 4 of the liquid dispensing apparatus 2 downwards towards the bottom wall 10. The plate 14 is designed to ensure that as the plate 14 is moved upwardly along the upright bars 22, the liquid in the liquid dispensing apparatus 2 that passes through the number of liquid dispensing openings 12 of the bottom wall 10, passes into any containers 63 under the bottom wall 10. While the plate 14 is being moved downwardly to be positioned on the bottom wall 10, forceful splashing of liquid is avoided by enabling liquid to pass upwardly through the liquid dispensing openings 16 of the plate 14 and to pass upwardly between edges of the plate 14 and the side wall 6 of the housing 4 of the liquid dispensing apparatus 2. Thus, with all the liquid having passed upwardly when the plate 14 was moving toward the bottom wall 10 and with the plate 14 covering the number of liquid dispensing openings 12 of the bottom wall 10 when the plate 14 rests on the bottom wall 10, flow of liquid through the number of liquid dispensing openings 12 of the bottom wall 10 is prevented when the plate 14 rests upon the bottom wall 10.

The primary vertical support 24 is connected to the plate 14 (as shown in FIG. 2B). As with the secondary vertical support 26, the primary vertical support 24 may be either removable or irremovable. One major difference between the primary vertical support 24 and the secondary vertical support 26 is that the primary vertical support 24 is attached to and extends upwardly from the plate 10 while the secondary vertical support 26, which acts as a fulcrum, is attached to and extends upwardly from the bottom wall 10. Therefore, when the plate 14 is moved upwards and downwards, the secondary vertical support 26 remains stable and does not move while the primary vertical support 24, being attached to the plate 14, moves up and down along with the plate 14. In a preferred embodiment, the secondary vertical support 26 (serving as the fulcrum) consists of a bar and is irremovably attached to the bottom wall 10. Although higher expenses would be incurred, there is an option of separately and removably attaching the secondary vertical support 26 to the bottom wall 10. However, the expenses of producing liquid dispensing apparatus using the removably attached secondary vertical support 26 is sufficiently higher to most probably result in deletion of the removably attached secondary vertical support 26 as a practical option.

Upright bars of various shapes may be chosen for the primary vertical support 24 and for the secondary vertical support 26. (Please refer to FIGS. 1B, 2B and 6.) Although different shapes may be used, a cylindrical bar is preferred. The primary vertical support 24 and the secondary vertical support 26 each have an upper section 42,46 and a lower section 44,48. In a preferred embodiment shown in FIGS. 1B, 2B and 6, the upper section 46 of the secondary vertical support 26 has a vertical cut 52. Preferably, the vertical cut 52 of the secondary vertical support 26 is a diameter of the secondary vertical support 26. Similarly, the upper section 42 of the primary vertical support 24 has a vertical cut 50. Preferably, the vertical cut 50 of the primary vertical support 24 is a diameter of the primary vertical support 24. Many other embodiments of the primary vertical support 24 and the secondary vertical support 26 may be used. The shape of the primary vertical support 24 and of the secondary vertical support 26 is not important in the structure and operation of the liquid dispensing apparatus 2. It is the vertical cut 50,52 that plays an essential role in the operation of and is the major feature of the primary vertical support 24 and of the secondary vertical support 26. The vertical cut 50,52 must provide sufficient free space for movement of the lever 28 when the lever 28 is being moved upwards and downwards by the user.

Meanwhile, the vertical cut 50,52 may be provided in various manners. In a preferred embodiment, the vertical cut 50,52 is simply a cut out of a portion of the primary vertical support 24 and of a portion of the secondary vertical support 26. In the figures, a preferred embodiment of the primary vertical support 24 and of the secondary vertical support 26 is shown. However, the invention is not limited to these embodiments and the embodiments are solely provided as a presentation of some preferred samples of the invention. In FIGS. 1B, 2B and 6, the primary vertical support 24 consists of a support bar 54 as its lower section 44 and of connectable, holding elements 56 as its upper section 42. Preferably, the support bar 54 has a top end 58 from which a flat sheet 60 with a hole extends upwardly. The flat sheet 60 is sandwiched by the connectable, holding elements 56 which preferably consist of two sheets each having a number of holes. A removable blocking element 62 is used. The removable blocking element 62 enables the connectable holding elements 56 to hold the lever 28 in a desired position. In a preferred embodiment (as shown in FIG. 2B), the removable blocking element 62 consists of a removable pin 62 that is passed through a lower hole in each sheet of the connectable, holding elements 56 and the hole in the support bar 54, such that the flat sheet 60 of the support bar 54 is sandwiched between the connectable, holding elements 56 and the removable pin 62 passes through one sheet of the connectable, holding elements 56, through the flat sheet 60 of the support bar 54 and finally through the other sheet of the connectable, holding elements 56. Another removable pin 62 is passed through an upper hole in each sheet depending upon the height selected for positioning of the lever 28. The removable pin 62 is passed through the upper hole in one sheet of the connectable, holding elements 56, then through the lever 28 and finally through the upper hole in the other sheet of the connectable, holding elements 56. As a result, the position of the removable pin 62 and, thus, of the lever 28 may be easily changed. A change in the position of the lever 28 results in different amounts of lifting and lowering of the plate 14 by the same amount of pressure exerted by the user on the lever 28.

In other preferred embodiments, the primary vertical support 24 or the secondary vertical support 26 may be of similar construction to one another or may be of other different structures. The shapes of the primary vertical support 24 and of the secondary vertical support 26 are not limited by the operation of the liquid dispensing apparatus 2.

Even though the vertical cuts 50,52 shall provide sufficient free space for movement of the lever 28, some blockage must be available on top of the vertical cut 50 of the primary vertical support 24 and on top of the vertical cut 52 of the secondary vertical support 26 to prevent escape of the lever 28 from each vertical cut 50,52, respectively. Any type of blocking element 62 may be used for preventing escape of the lever 28. As in all other cases, a removable blocking element 62 for the primary vertical support 24 and a removable blocking element 62 for the secondary vertical support 26 are preferred. As an example, a cap may be used as the removable blocking element 62. In a preferred embodiment, a removable pin may be used as the removable blocking element 62. If the removable pin is to be used, a hole is engraved towards top of the upper section 42 of the primary vertical support 24 and a hole is engraved towards top of the upper section 46 of the secondary vertical support 26. The hole of the primary vertical support 24 runs diametrically through the primary vertical support 24. Similarly, the hole of the secondary vertical support 26 runs diametrically through the secondary vertical support 26. After the lever 28 is placed in its proper position within the vertical cut 50 of the primary vertical support 24 or within the vertical cut 52 of the secondary vertical support 26 and is adjusted as required, each removable pin is passed through its corresponding hole in the upper section 42,46 of the primary vertical support 24 or of the secondary vertical support 26, respectively, such that while the lever 28 is moving upwards, the removable pin blocks any further upward movement of the lever 28 when the lever 28 reaches the removable pin.

The lever 28 comprises a front end 64, a back end 66 and a number of openings 68 positioned towards the front end 64 (as shown in FIGS. 1B, 2B and 6). The lever 28 runs through, connects to each other and is removably attached to the primary vertical support 24 and the secondary vertical support 26. One portion of the lever 28 is positioned within the vertical cut 50 of the primary vertical support 24 and another portion of the lever 28 is positioned within the vertical cut 52 of the secondary vertical support 26. A first opening towards the front end 64 of the lever 28 is positioned amidst the vertical cut 50 of the primary vertical support 24. Depending upon the position of the secondary vertical support 26 in comparison to the primary vertical support 24, a different location may be used for the a second opening that is farther from the front end 64 of the lever 28 than the first opening. If the secondary vertical support 26 is irremovable, only one opening 68 on the lever 28 would be applicable in relation to the primary vertical support 24.

The number of openings 68 may be longer, allowing a free passage of the removable pin through each opening 68. With the lever 28 serving to raise the plate 14, the size of each opening 68 is a determinative factor in the amount of lift. Up to a certain extent, an opening 68 that is longer provides an option of having a longer vertical distance for moving the plate 14 upwards and downwards and, thus, an option of providing more variations in quantities of liquid that may be poured through the number of liquid dispensing openings 12 of the bottom wall 10. When the lever 28 is moved upwardly and downwardly, the vertical cut 50 in the primary vertical support 24 and the vertical cut 52 in the secondary vertical support 26 serve as a free space for movement of the lever 28 therethrough. Since while the lever 28 moves up and down, the lever 28 rotates and undergoes a positioning at various angles, the vertical cut 50 in the primary vertical support 24 and the vertical cut 52 in the secondary vertical support 26 allow free space for rotation and angular repositioning of the lever 28.

The distance between the number of openings 68 of the lever 28 is one factor in limiting the amount of liquid to be poured from the liquid dispensing apparatus 2. The longer is the distance between the number of openings 68 of the lever 28, the higher the lever 28 can be raised and, thus, a larger amount of liquid can be poured out at any one lift of the plate 14. Of course, there is a limitation to the distance between the number of openings 68 of the lever 28, particularly based on limitations in the length of the lever 28 and in the height of the vertical cut 50 in the primary vertical support 24 and in the height of the vertical cut 52 in the secondary vertical support 26. The timing of holding the handle 33 down is another determinative factor for the amount of liquid to be poured from the liquid dispensing apparatus 2. In some versions of the liquid dispensing apparatus 2, the secondary vertical support 26 or the primary vertical support 24 or both are designed to allow positioning of the number of openings 68 of the lever 28 at different locations with respect to each other. Therefore, different amounts of liquid may be poured at different times by exertion of the same amount of force depending upon the design of the primary vertical support 24 and the design of the secondary vertical support 26.

Many complicated designs have been used in liquid dispensing apparatus for controlling rate of flow. In most liquid dispensing apparatus, the designs for controlling rate of flow have been unsuccessful since the designs have been either complicated or expensive or both. In the present invention, a relatively simple structure is used for controlling and increasing rate of flow, for deleting complications, turbulence and uneven flow rates and for minimizing expenses.

The liquid dispensing apparatus 2 is very simple to operate and can be operated manually by relatively unskilled labor. When it is desired to dispense liquid, the lever 28 is lowered for a desired time sufficient to provide a required amount of pour of liquid. When the lever 28 is lowered, the plate 14 is lifted (as shown in FIG. 6). When the plate 14 is lifted, liquid above the plate 14 is able to flow downward through the liquid dispensing openings 16 in the plate 14 since the liquid dispensing openings 16 in the plate 14 are no longer blocked by the bottom wall 10 as soon as the plate 14 is lifted. The liquid that flows through the liquid dispensing openings 16 of the plate 14 reaches the bottom wall 10 and flows through the number of liquid dispensing openings 12 of the bottom wall 10. Since there is no blockage of the number of liquid dispensing openings 12 of the bottom wall 10, the liquid is allowed to be simultaneously dispensed to any containers 63 that are positioned under the bottom wall 10. Meanwhile, when the plate 14 is lifted, the liquid flows downwardly between edges of the plate 14 and the side wall 6 of the housing 4 of the liquid dispensing apparatus 2. As the plate 14 moves upwards, the liquid, whether moving downwardly through the liquid dispensing openings 16 of the plate 14 or between edges of the plate 14 and the side wall 6, ends up on the bottom wall 10 of the housing 4 of the liquid dispensing apparatus 2 and passes through the number of liquid dispensing openings 12 of the bottom wall 10. The plate 14 moves upwards along the spring-loaded upright bars 22 to allow filling of the containers 63 to the desired level. The plate 14 is lifted up to compress springs 38 of the spring-loaded upright bars 22 and kept along the spring-loaded upright bars 22 at a distance above the bottom wall 10 for a sufficiently long period to allow pouring of a desired amount of liquid. After the desired amount of liquid is poured out of the liquid dispensing apparatus 2, the lever 28 is lifted and the plate 14 is returned to its original position to rest upon the bottom wall 10 such that the number of liquid dispensing openings 12 of the bottom wall 10 correspond to and fall under liquid dispensing openings 16 of the plate 14 that are blocked at their ends by rubber-like inserts 18 while the liquid dispensing openings of the plate 14 correspond to and fall over surface of the bottom wall 10. When the plate 14 is lowered, the liquid under the plate 14 moves upwards through the liquid dispensing openings 16 of the plate 14 and moves upwards between the side wall 6 of the housing 4 of the liquid dispensing apparatus 2 and edges of the plate 14. Thus, forceful splashing of any liquid that may remain under the plate 14 while the plate 14 is striking the bottom wall 10 of the housing 4 is avoided. Therefore, when the lever 28 is lowered, liquid starts to pour out of the liquid dispensing apparatus 2 and flow of liquid is totally blocked when the lever 28 is raised back to its original position.

One advantage of the liquid dispensing apparatus 2 results from the fact that beverages, when served in large quantities, are served in paper cups or containers 63 instead of glass cups or bottles. When light-weight paper cups or containers 63 are used, several problems exist when attempts are made to pour the beverage quickly into large numbers of paper containers 63. There is always the possibility of overturning the paper container 63. In addition, the beverage may be spilled. For some beverages, if the beverage is poured quickly, a head may form and only a portion of the paper container 63 may be filled with the beverage. Thus, the period of filling the paper container 63 may be very slow and time-consuming. The liquid dispensing apparatus 2, on the other hand, speeds up the process of pouring beverages into paper containers 63 by using receptacles 51 of paper containers 63. As long as a group of paper containers 63 are themselves placed in a stable position under the liquid dispensing apparatus 2, the paper containers 63 are filled simultaneously, quickly and efficiently. There is no possibility of overturning of the paper containers 63 by the liquid dispensing apparatus 2. As long as an individual controls the operation of the liquid dispensing apparatus 2, there is no spilling of the beverage. Meanwhile, the speed of dispensing of the beverage can be easily adjusted as desired since a relatively large number of containers 63 can be prepared simultaneously.

Another advantage of the liquid dispensing apparatus 2 is its extremely low operation and maintenance expenses compared to other liquid dispensing apparatus 2 and systems. Valves, faucets, hoses and funnels are components of some inventions which are deleted from the present invention. By deleting such components, not only is there a decrease in expenses of construction of the present invention, there are less chances of malfunctioning of the improved liquid dispensing apparatus 2.

The design of conventional liquid dispensing apparatus, with numerous parts and complicated structures, does not lend itself to easy cleaning. It is necessary to clean such complicated structures regularly to remove stale and decomposed particles for sanitary as well as taste purposes. The present invention, with fewer parts and a simple structure, is much easier to clean. The components of the improved liquid dispensing apparatus 2, which are only a few, are very easily separable and can be cleaned in a short period of time and without requiring any special skills. Due to its simple structure and lack of components which can hold stale and decomposed particles, it is not necessary to clean the improved liquid dispensing apparatus 2 regularly to remove stale and decomposed particles neither for sanitary nor for taste purposes.

Many conventional liquid dispensing apparatus 2, including manually-operated valve and valve displaced from the faucet, lend themselves to substantial waste. In many such cases, it is most often necessary to dispose of the liquid trapped in the conduit or reservoir before pouring fresh liquid. In the present invention, every drop of the liquid is used.

Certain objects are set forth above and made apparent from the foregoing description, drawings and examples. However, since certain changes may be made in the above description, drawings and examples without departing from the scope of the invention, it is intended that all matters contained in the foregoing description, drawings and examples shall be interpreted as illustrative only of the principles of the invention and not in a limiting sense. With respect to the above description and examples then, it is to be realized that any descriptions, drawings and examples deemed readily apparent and obvious to one skilled in the art and all equivalent relationships to those stated in the examples and described in the specification or illustrated in the drawings are intended to be encompassed by the present invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention. It is also to be understood that the following claims are intended to cover all of the generic and specific features of the invention herein described, and all statements of the scope of the invention which, as a matter of language, might be said to fall in between.

What is claimed as invention is:

1. A container and liquid dispensing apparatus for simultaneously and instantaneously dispensing multiple containers into a receptacle and for filling said containers simultaneously and instantaneously with a desired liquid, said container and liquid dispensing apparatus comprising:

(a) a container dispensing apparatus, for simultaneously and instantaneously dispensing multiple individual containers into a receptacle, comprising:

A. a housing in the form of a block that has a peripheral wall, internal, axial bores for receiving a column of containers and a central, axial bore, B. at least three upright legs that are attached to or are extensions of the peripheral wall of and that support the housing, C. a cover that is positioned above the housing and that has a number of downwardly extending rods and a downwardly extending, central pipe that are each positioned within a corresponding internal, axial bore of the housing when the cover is positioned upon the block of the housing, D. a vertical bar that is attached to and uprises from the housing and that protrudes through the cover, with notches being positioned along the vertical bar, E. a guide for the vertical bar, said guide being attached to the cover, F. a pair of friction pads separating the guide for the vertical bar from the vertical bar while acting as a reenforceable brake, G. a handle, having a spring-loaded pawl, that is engaged with the vertical bar, and H. a fulcrum that is attached to the cover and that is engaged with and that supports the handle; and (b) a liquid dispensing apparatus for simultaneously and instantaneously filling with liquid said multiple individual containers dispensed by the container dispensing apparatus into the receptacle after the receptacle has been moved from under the container dispensing apparatus and positioned under the liquid dispensing apparatus, said liquid dispensing apparatus comprising:

A. a housing that comprises a side wall and a bottom wall that is provided with a number of liquid dispensing openings for allowing passage of liquid into a plurality of containers placed individually in the receptacle positioned below the bottom wall, B. at least three upright stands that are attached to or are extensions of the side wall and upon which the housing is mounted, C. a plate, serving as a valve, that is positioned upon the bottom wall of the housing, that has liquid dispensing openings at end of which rubber-like inserts are used and which correspond to and lie above the number of liquid dispensing openings of the bottom wall and that has open liquid dispensing openings being retained away from the number of liquid dispensing openings and above surfaces of the bottom wall, with a portion of the bottom wall that does not include any liquid dispensing openings being uncovered by the plate, D. at least three upright bars that are attached to and extend upwardly from the bottom wall of the liquid dispensing apparatus, that are each surrounded by a spring and that are each closed at its top by an attachment which limits movements of the corresponding spring, with the plate being raised and lowered along the upright bars, E. a primary vertical support that is attached to and extends upwardly from the plate, F. a secondary vertical support that acts as a fulcrum and that is attached to and extends upwardly from the bottom wall, and G. a lever that extends between, passes through, is attached to and connects, to each other, the primary vertical support and the secondary vertical support and serves to raise the plate.

2. The container and liquid dispensing apparatus according to claim 1, wherein in the container dispensing apparatus, the pair of friction pads consists of a fixed friction pad and an adjustable friction pad, with a fixed screw set maintaining the fixed friction pad fixed and an adjustable screw set allowing the adjustable friction pad to be adjustable to allow lifting and lowering of the cover along the vertical bar.

3. The container and liquid dispensing apparatus according to claim 1, wherein the friction pads of the container dispensing apparatus are U-shaped.

4. The container and liquid dispensing apparatus according to claim 1, wherein three upright legs are used for the container dispensing apparatus, with two upright legs being positioned at a closer angle to one another and a third upright leg being positioned at a larger angle in relationship to both upright legs, such that removal of a receptacle of containers is not obstructed by the upright legs.

5. The container and liquid dispensing apparatus according to claim 1, wherein the block which forms the housing of the container dispensing apparatus is cylindrical and has a central axis.

6. The container and liquid dispensing apparatus according to claim 1, wherein the housing of the container dispensing apparatus has groups of internal, axial bores that are arranged circumferentially about the central axis of the block at a predetermined radius, such that internal, axial bores are separated from neighboring internal, axial bores, of a larger or smaller diameter, by an equal angle.

7. The container and liquid dispensing apparatus according to claim 1, wherein towards its bottom, for at least one-half inch in length, the internal, axial bore of the container dispensing apparatus is smaller in diameter than the container in order to ensure that the container will not freely drop from the internal, axial bore.

8. The container and liquid dispensing apparatus according to claim 1, wherein, to assist in controlling drop of containers by the container dispensing apparatus, at least three relatively flexible strips are attached to bottom of the housing of the container dispensing apparatus around bottom of each internal, axial bore, such that the relatively flexible strips are sufficiently strong to support containers while allowing fall of a container with minimal movement when desired.

9. The container and liquid dispensing apparatus according to claim 1, wherein the guide for the vertical bar of the container dispensing apparatus comprises a pair of horizontal sides and a middle tubular body connecting the two horizontal sides, with the middle tubular body having a central opening through which the vertical bar is passed.

10. The container and liquid dispensing apparatus according to claim 1, wherein, in the container dispensing apparatus, the notches are positioned along the vertical bar on a side that is facing neither the fulcrum nor the pair of friction pads, such that a user can move a portion of the handle along the vertical bar without any injuries to the user.

11. The container and liquid dispensing apparatus according to claim 1, wherein, in the container dispensing apparatus, the notches are equally distanced, with distance between neighboring notches corresponding to distance between neighboring containers such that each time the handle is moved downward, one container can be dispensed from each internal, axial bore.

12. The container and liquid dispensing apparatus according to claim 1, wherein the spring-loaded pawl of the handle of the container dispensing apparatus engages with notches in the vertical bar.

13. The container and liquid dispensing apparatus according to claim 1, wherein the fulcrum of the container dispensing apparatus is affixed to the cover above or adjacent to an opening for the downwardly extending, central pipe.

14. The container and liquid dispensing apparatus according to claim 1, wherein the fulcrum of the container dispensing apparatus has a horizontal base and two parallel vertical walls that extend upwards from the horizontal base and at a certain distance from one another, with the horizontal base of the fulcrum being attached to the cover and the parallel vertical walls of the fulcrum being loosely attached to the handle which fits accurately amidst the parallel vertical walls.

15. The container and liquid dispensing apparatus according to claim 1, wherein the rubber-like inserts that are used at end of some liquid dispensing openings of the plate of the liquid dispensing apparatus consist of wood or plastic.

16. The container and liquid dispensing apparatus according to claim 1, wherein the bottom wall of the housing for the liquid dispensing apparatus has only one liquid dispensing opening and a spider-like dispenser is connected to the liquid dispensing opening of the bottom wall, said spider-like dispenser comprising:

(a) a tubular connecting body that is connected internally to the liquid dispensing opening of the bottom wall;

(b) a valve that is positioned in the tubular connecting body;

(c) a switch that is connected to the tubular connecting body for opening and closing the valve and that extends from the tubular connecting body to an upright stand or to an extension of the side wall of the liquid dispensing apparatus;

(d) a base that is positioned below and that supports the tubular connecting body and that is connected internally to the tubular connecting body; and (e) tubes that are arranged in the shape of spider legs around the base, that exit from the base and that are connected internally to the base.

17. The container and liquid dispensing apparatus according to claim 1, wherein each upright bar of the liquid dispensing apparatus comprises a lower section that passes through a corresponding liquid dispensing opening of the plate, a lower end that is attached to the bottom wall, an upper section surrounded by the spring, an upper end that is closed by the attachment which limits movement of the spring.

18. The container and liquid dispensing apparatus according to claim 1, wherein the plate of the liquid dispensing apparatus is structured to be in a range of about 1" to about 1½" smaller in diameter than the housing of the liquid dispensing apparatus.

19. The container and liquid dispensing apparatus according to claim 1, wherein the primary vertical support and the secondary vertical support consist of an upright bar.

20. The container and liquid dispensing apparatus according to claim 1, wherein the primary vertical support and the secondary vertical support of the liquid dispensing apparatus each comprises:

(a) an upper section that has a vertical cut that is a diameter of the primary vertical support and of the secondary vertical support and within which a portion of the lever is positioned, such that the vertical cut provides sufficient free space for movement of the lever when the lever is moved upwards and downwards by a user; and (b) a lower section.

21. The container and liquid dispensing apparatus according to claim 1, wherein the primary vertical support of the liquid dispensing apparatus, the secondary vertical support of the liquid dispensing apparatus or both comprise:

(a) an upper section that includes connectable, holding elements consisting of two sheets each having a number of holes, with a removable blocking element being used to enable the connectable, holding elements to hold the lever in a desired position; and (b) a lower section that includes a support bar, with the support bar having a top end from which a flat sheet with a hole extends upwardly, said flat sheet being sandwiched by the connectable, holding elements.

22. The container and liquid dispensing apparatus according to claim 21, wherein the removable blocking element consists of a removable pin that is passed through a hole in one sheet of the connectable, holding elements, then through the lever and finally through a hole in the other sheet of the connectable, holding elements, such that position of the lever is changeable and a change in position of the lever results in different amounts of lifting and lowering of the plate upon exertion of an equal amount of pressure.

23. A method of application of a container and liquid dispensing apparatus for simultaneously and instantaneously dispensing multiple containers into a receptacle and for filling said containers simultaneously and instantaneously with a desired liquid, said container and liquid dispensing apparatus comprising:

(a) a container dispensing apparatus, for simultaneously and instantaneously dispensing multiple individual containers into a receptacle, comprising:

A. a housing in the form of a block that has a peripheral wall, internal, axial bores for receiving a column of containers and a central, axial bore, B. at least three upright legs that are attached to or are extensions of the peripheral wall of and that support the housing, C. a cover that is positioned above the housing and that has a number of downwardly extending rods and a downwardly extending, central pipe that are each positioned within a corresponding internal, axial bore of the housing when the cover is positioned upon the block of the housing, D. a vertical bar that is attached to and uprises from the housing and that protrudes through the cover, with notches being positioned along the vertical bar, E. a guide for the vertical bar, said guide being attached to the cover, F. a pair of friction pads separating the guide for the vertical bar from the vertical bar while acting as a reenforceable brake, G. a handle, having a spring-loaded pawl, that is engaged with the vertical bar, and H. a fulcrum that is attached to the cover and that is engaged with and that supports the handle; and (b) a liquid dispensing apparatus for simultaneously and instantaneously filling with liquid said multiple individual containers dispensed by the container dispensing apparatus into the receptacle after the receptacle has been moved from under the container dispensing apparatus and positioned under the liquid dispensing apparatus, said liquid dispensing apparatus comprising:

A. a housing that comprises a side wall and a bottom wall that is provided with a number of liquid dispensing openings for allowing passage of liquid into a plurality of containers placed individually in the receptacle positioned below the bottom wall, B. at least three upright stands that are attached to or are extensions of the side wall and upon which the housing is mounted, C. a plate, serving as a valve, that is positioned upon the bottom wall of the housing, that has liquid dispensing openings at end of which rubber-like inserts are used and which correspond to and lie above the number of liquid dispensing openings of the bottom wall and that has open liquid dispensing openings being retained away from the number of liquid dispensing openings and above surfaces of the bottom wall, with a portion of the bottom wall that does not include any liquid dispensing openings being uncovered by the plate, D. at least three upright bars that are attached to and extend upwardly from the bottom wall of the liquid dispensing apparatus, that are each surrounded by a spring and that are each closed at its top by an attachment which limits movements of the corresponding spring, with the plate being raised and lowered along the upright bars, E. a primary vertical support that is attached to and extends upwardly from the plate, F. a secondary vertical support that acts as a fulcrum and that is attached to and extends upwardly from the bottom wall, and G. a lever that extends between, passes through, is attached to and connects, to each other, the primary vertical support and the secondary vertical support and serves to raise the plate;

said method comprising:

(a) placing a receptacle under the container dispensing apparatus, with the receptacle having no containers and having openings that correspond in numbering and position exactly to the internal, axial bores and that are a little larger than bottom of the containers;

(b) loading containers in the internal, axial bores of the housing of the container dispensing apparatus upon removing the cover;

(c) repositioning the cover upon placing each downwardly extending rod in the corresponding internal, axial bore, upon simultaneously placing the downwardly extending, central pipe into the central, axial bore of the block and upon simultaneously passing the vertical bar through an opening in the cover and upwardly through the guide for the vertical bar such that the vertical bar extends above and perpendicularly to the cover and such that the handle is engaged with the fulcrum and with notches on the vertical bar;

(d) putting thumb on the spring-loaded pawl to raise the spring-loaded pawl and to separate the spring-loaded pawl from the notch on the vertical bar;

(e) while holding the spring-loaded pawl open, grasping the handle by the other hand, raising the cover along the vertical bar until the cover has reached a desired position and, then, releasing the spring-loaded pawl to link the handle with the vertical bar;

(f) moving the handle upwards, resulting in lowering of the spring-loaded pawl one notch, and then moving the handle downwards, resulting in downward movement of the number of downwardly extending rods and disposal of a lowermost container out of each internal, axial bore which has an uppermost container in its nested column of containers that is reached by the corresponding downwardly extending rod;

(g) removing the receptacle, in which containers are disposed by the container dispensing apparatus, from under the container dispensing apparatus and positioning the receptacle under the liquid dispensing apparatus;

(h) pouring the desired liquid into the liquid dispensing apparatus if no more liquid remains in the liquid dispensing apparatus;

(i) lowering the lever, resulting in lifting of the plate upwards along the upright bars and in compression of the springs, with the liquid above the plate reaching the bottom wall of the housing of the liquid dispensing apparatus upon flowing downwards through the liquid dispensing openings of the plate that are not blocked by any rubber-like inserts and upon flowing between edges of the plate and the side wall of the housing of the liquid dispensing apparatus when the plate is lifted and, after reaching the bottom wall, flowing through the number of liquid dispensing openings of the bottom wall into any containers in the receptacle under the liquid dispensing apparatus;

(j) lifting the lever, resulting in lowering of the plate downwards along the upright bars until the plate is returned to its original position, before having been raised, upon the bottom wall of the liquid dispensing apparatus, with any liquid positioned under the plate flowing upwards through the liquid dispensing openings of the plate and flowing upwards from between the side wall of the housing of the liquid dispensing apparatus and the edges of the plate, such that forceful splashing of the liquid is avoided when the plate strikes the bottom wall of the housing of the liquid dispensing apparatus and such that as long as the plate rests on the bottom wall, any liquid that passes through the liquid dispensing openings of the plate and any liquid that flows between edges of the plate and the side wall of the housing of the liquid dispensing apparatus are stopped by the closed surface of the bottom wall and remain in the housing of the liquid dispensing apparatus until the plate is raised above the bottom wall; and (k) repeating steps (a), (f), (g), (h), (i) and (j) until the number of downwardly extending rods dispose all containers out of all internal, axial bores.

24. The method of application of a container and liquid dispensing apparatus according to claim 23, wherein step (g) of claim 23 is followed immediately by step (a) and, then, step (f) is performed simultaneously, instead of in sequence, with steps (h), (i) and (j) of claim 23, such that speed of performance is increased.

25. The method of application of a container and liquid dispensing apparatus according to claim 23, wherein the cover is removed by loosening a friction pad of the pair of friction pads, while the other friction pad remains fixed to constantly hold the guide for the vertical bar against the vertical bar.

26. The method of application of a container and liquid dispensing apparatus according to claim 23, wherein the cover is repositioned by tightening a friction pad of the pair of friction pads against the vertical bar and against the guide for the vertical bar, while the other friction pad remains fixed to constantly hold the guide for the vertical bar against the vertical bar.

* * * * *